US008266926B1

(12) United States Patent
Leeds et al.

(10) Patent No.: US 8,266,926 B1
(45) Date of Patent: Sep. 18, 2012

(54) CIGARETTE URN HAVING COMPACT STORAGE STATE

(75) Inventors: Richard B. Leeds, Cold Spring Harbor, NY (US); Mark A. Goldberg, Lido Beach, NY (US)

(73) Assignee: Global Equipment Company Inc., Port Washington, NY (US)

( * ) Notice: Subject to any disclaimer, the term of this patent is extended or adjusted under 35 U.S.C. 154(b) by 464 days.

(21) Appl. No.: 12/435,504

(22) Filed: May 5, 2009

Related U.S. Application Data

(63) Continuation-in-part of application No. 11/362,647, filed on Feb. 27, 2006, now Pat. No. 7,748,605.

(51) Int. Cl.
*A24F 19/00* (2006.01)

(52) U.S. Cl. ..... 65/231; 220/576

(58) Field of Classification Search ..... 131/231; 220/576

See application file for complete search history.

(56) References Cited

U.S. PATENT DOCUMENTS

| | | | | |
|---|---|---|---|---|
| 1,645,525 | A | 10/1927 | Fleming | 232/42.2 |
| 1,646,086 | A | 10/1927 | Fleming | 232/42.2 |
| 1,646,099 | A | 10/1927 | Mitchell | 232/42.2 |
| 1,662,171 | A | 3/1928 | Savery | 232/42.2 |
| 1,670,525 | A | 5/1928 | Savery | 232/42.2 |
| 1,735,671 | A | 11/1929 | Bunker | 232/42.2 |
| 1,747,356 | A | 2/1930 | Fleming | 232/42.2 |
| 1,802,938 | A | 4/1931 | Burger | 131/240.1 |
| 1,807,079 | A | 5/1931 | Wilmanns | 232/43.2 |
| 1,921,933 | A | 8/1933 | Levenberg et al. | 232/43.5 |
| 2,059,105 | A | 10/1936 | Heisenfeldt | 232/43.2 |
| 2,114,027 | A | 4/1938 | McDonald | 248/159 |
| 4,741,937 | A | 5/1988 | Parker | 428/36.4 |
| 6,186,355 | B1 * | 2/2001 | Luedecke | 220/576 |
| 6,626,322 | B1 | 9/2003 | Carter et al. | 220/576 |
| 6,776,167 | B1 * | 8/2004 | Gillispie | 131/231 |
| 7,055,714 | B2 | 6/2006 | Perelli et al. | 220/576 |
| 2004/0060940 | A1 * | 4/2004 | Carter et al. | 220/576 |
| 2005/0005945 | A1 * | 1/2005 | Shaw et al. | 131/231 |
| 2006/0096992 | A1 * | 5/2006 | Weiss et al. | 220/576 |
| 2006/0180590 | A1 | 8/2006 | Perelli et al. | 220/576 |
| 2006/0196924 | A1 | 9/2006 | Cabalu | 232/43.2 |

* cited by examiner

*Primary Examiner* — Matthew Daniels
*Assistant Examiner* — Cynthia Szewczyk
(74) *Attorney, Agent, or Firm* — David W. Denenberg; Davidoff Hutcher & Citron LLP

(57) ABSTRACT

A cigarette urn and method of assembly of same that defines an interior passage for smoking debris to travel when multiple components of the urn are assembled into a self-standing, upright assembly condition. A top one of the multiple components has a sidewall opening. The multiple components may be disassembled from the self-standing, upright assembly condition into an overlapping assembly condition with the multiple components overlapping and taking up less overall volume that in the self-standing, upright assembly condition. A fire retardant or heat resistant material may be lining an interior contour of a base of the multiple components. The top one of the multiple components may be of substantially uniform diameter along a majority of its length.

23 Claims, 17 Drawing Sheets

CIGARETTE URN HAVING COMPACT STORAGE STATE

CROSS-REFERENCE TO CO-PENDING APPLICATION

The present application is a continuation-in-part of U.S. patent application Ser. No. 11/362,647 filed Feb. 27, 2006, now U.S. Pat. No. 7,748,605.

BACKGROUND OF THE INVENTION

1. Field of the Invention

The present invention relates generally to systems and methods for disposal of cigarette waste; and, more specifically, to an indoor or an outdoor cigarette urn that allows easy clean-up of cigarette remnants and prevents unpleasant odors from escaping into a surrounding environment. The present invention also relates to an indoor or an outdoor cigarette urn that can be packaged, shipped and stored in a compact state and then assembled into a use state that presents one or more smoking waste insertion openings at a raised height above the ground to thereby enable smokers to easy dispose of their cigarette remnants and other waste.

2. Background Art

Even with the ban on smoking in restaurants, bars, and other public places in some states, the number of smokers did not decline. In the states where the ban is in effect, smokers congregate in front of buildings to smoke. While smoking in front of a building, smokers' cigarettes produce a lot of ashes and burnt cigarette remnants. Typically, a smoker would tap on a cigarette to shake off the ashes. The ashes spread in the air and then fall on the ground. This causes pollution, dirt, and other unsightly conditions to spread around. Similarly, many smokers throw burnt cigarette remnants on the street as well. Some smokers even throw out lit cigarettes without extinguishing. This causes cigarettes to continue burning and spreading unpleasant smells and creating fire hazards.

In the states where smoking is allowed in restaurants, bars, and other public places, smokers typically shake off cigarette ashes and extinguish cigarettes in an ashtray. Besides being unsightly, burning or burnt cigarettes in an ashtray spread unpleasant smells to the surrounding environment if ashtrays are not immediately cleaned. Even if ashtrays are immediately cleaned, some of the cigarettes can still be burning and, thus, cause fires in trash compactors.

There have been many attempts to find a solution to the above problems. Some solutions prevent littering of the environment from the ashes and burnt cigarette remnants but create unpleasant smells and do not allow easy clean up of the container collecting cigarette waste. Some allow clean up but may present other hazards. Therefore, there exists a need for a better cigarette disposal container capable of keeping the environment lifter-free, eliminating unpleasant smells, preventing fires, and allowing easy clean up. The present invention provides such a container.

Further, some conventional containers are bulky and difficult to package and ship. Thus, there is a need for a cigarette urn that can be easily packaged and shipped.

SUMMARY OF THE INVENTION

One aspect of the invention resides in a cigarette urn and method of assembly of same that defines an interior passage for smoking debris to travel when multiple components of the urn are assembled into a self-standing, upright assembly condition. A top one of the multiple components preferably has a sidewall opening. The multiple components may be disassembled from the self-standing, upright assembly condition for shipping purposes into an overlapping assembly condition with the multiple components overlapping and taking up less overall volume that in the self-standing, upright assembly condition. A fire retardant or heat resistant material may line an interior contour of a base of the multiple components. The lining is secured to the interior contour to prevent its movement relative to the base if the base is jostled. The top one of the multiple components may be of substantially uniform diameter along at least a majority of its full length.

Further features and advantages of the present invention as well as the structure and operation of various embodiments of the present invention are described in detail below with reference to the accompanying drawings.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

The present invention is described with reference to the accompanying drawings. In the drawings, like reference numbers indicate identical or functionally similar elements. Additionally, the leftmost digit of a reference number identifies the drawing in which the reference number first appears.

DETAILED DESCRIPTION OF THE INVENTION

While the present invention is described herein with reference to illustrative embodiments for particular applications, it should be understood that the invention is not limited thereto. Those skilled in the art with access to the teachings provided herein will recognize additional modifications, applications, and embodiments within the scope thereof and additional fields in which the present invention would be of significant utility.

The present invention provides for a clean and safe disposal of ashes and smoked cigarettes, cigars, or other smoking objects (hereinafter "smoking debris"). The present invention substantially eliminates unpleasant smells by including an enclosed urn, which prevents emanation of smells into the surrounding environment. Further, the present invention eliminates fires caused by a cigarette that was not properly extinguished. The present invention is designed to receive a burning cigarette into a liner and extinguish it by depriving it of oxygen. Finally, the present invention allows easy clean-up of the urn.

FIGS. 1-12 and 14-16 illustrate various embodiments of a cigarette urn according to the present invention.

Figure 1:
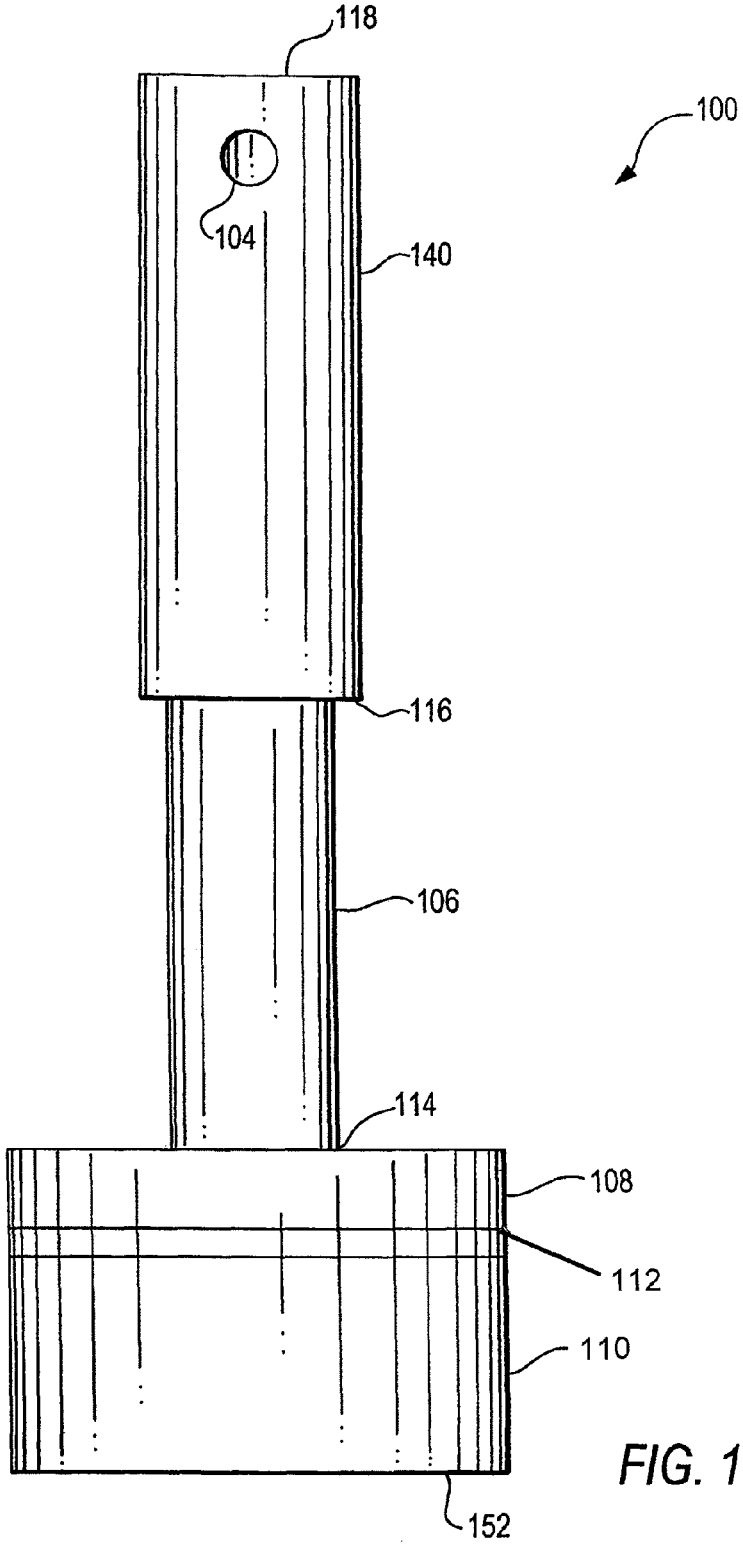
FIG. 1 illustrates a block diagram of a cigarette urn, according to the present invention.

FIG. 1 illustrates an embodiment of a cigarette urn 100, according to the present invention. The urn 100 includes an upper portion 140, a first middle portion 106, a second middle portion 108, and a base 110. The upper portion 140 is releasably coupled to the first middle portion 106; the first middle portion is releasably coupled to the second middle portion; and the second middle portion 108 is releasably coupled to the base 110. The upper portion 140 includes a closed top 118, which is vertically spaced from the base. The upper portion 140 further includes an opening 104 for placement of smoking debris. The upper portion 140 may include more than one opening 104.

The base 110 further has a bottom 152 used to place the cigarette urn 100 on a surface. The urn 100 may be secured to such surface using bolts, cement, glue, or any other fastening methods.

The upper portion 140 is releasably secured to the first middle portion 106 at a junction 116. The first middle portion 106 is releasably secured to the second middle portion 108 at a junction 114. The second middle portion 108 is releasably secured to the base 110 at a junction 112. The first middle portion 106 has a smaller cross-section than the upper portion 140 and the second middle portion 108. Because of the smaller cross-section, the first middle portion 106 can be screwed onto or otherwise joined with the upper portion 140 and the second middle portion 108.

The first middle portion 106 may contain threading at the junctions 114 and 116. Similarly, the upper portion 140 and the second middle portion 108 may contain corresponding threading to mate with first middle portion's threading. The smaller cross-section and the threading allow the first middle portion 106 to be inserted into the upper portion 140 and joined using its threading or other coupling mechanism to releasably secure the upper portion 140 and the first middle portion 106. Similarly, the first middle portion 106 is releasably secured with the second middle portion 108. The releasably securing of the parts to each other allows for faster assembly and disassembly during packaging, shipping, installation or for cleaning purposes.

The upper portion 140, first middle portion 106, and second middle portion 108 may be secured to each other in any other way. For example, bolts, glue, welding or other methods may be used to couple together the parts of the upper portion 140.

Figure 2:
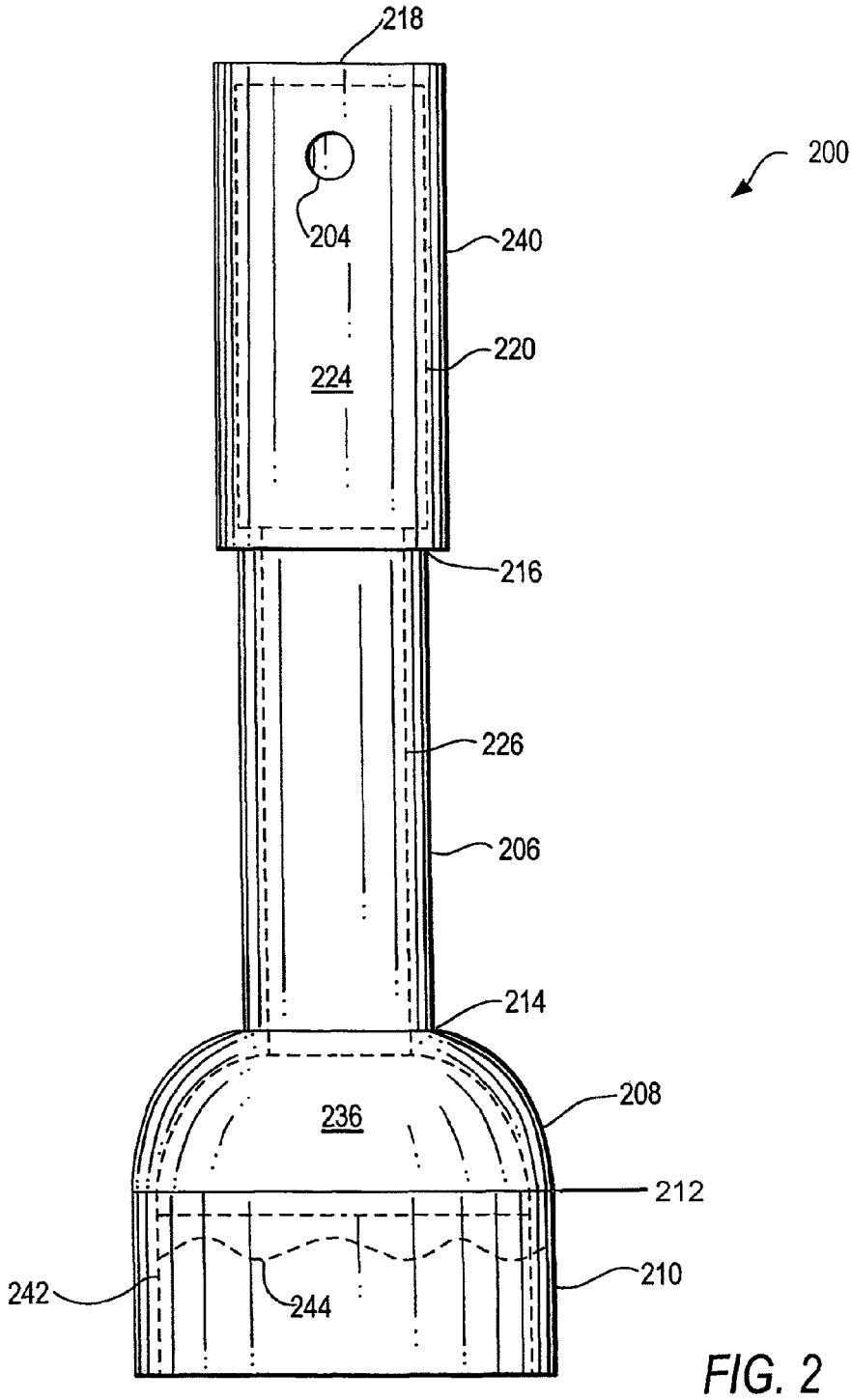
FIG. 2 is a more detailed view of the cigarette urn shown in FIG. 1.

The upper portion 140, the first and second middle portions 106, 108, and the base 110 contain respective interior spaces. These interior spaces are in communication with each other and with the opening 104. Turning to FIG. 2, the interior of the cigarette urn 100 allows a user to place smoking debris through the opening 104 and into the interior spaces of the upper portion 140, the first and second middle portion 106, 108, and the base 110. The smoking debris falls through the interior spaces and accumulates in the interior of the base. Collectively, the interior spaces form an internal passage.

FIG. 2 illustrates an alternate embodiment of the cigarette urn 200. The cigarette urn 200 includes an upper portion 240, a first middle portion 206, a second middle portion 208, and a base 210. The upper portion 240 is releasably secured to the first middle portion 206 at a junction 216. The first middle portion 206 is releasably secured to the second middle portion 208 at a junction 214. The second middle portion 208 is releasably secured to the base 210 at a junction 212.

The upper portion 240 further includes a closed top 218 and an opening 204 in one of its sidewalls. The upper portion 240 may include more than one opening 204 in its sidewalls.

The upper portion 240 includes an interior space 220. The interior space 220 is enclosed by the walls of the upper portion 240 and communicates with the opening 204. The first middle portion 206 further includes an interior space 226. The interior part 226 is enclosed by the walls of the first middle portion 206 and communicates with the interior space 220 through an opening at the junction 216. The interior spaces 220 and 226 form a common internal passage 224, together with an interior 236 of the second middle portion 208 through an opening located at the junction 214. The interior space 236 is enclosed by the walls of the second middle portion 208. The internal passage 224 may have a substantially uniform cross-section throughout the upper and first middle portions parts 240 and 206, respectively.

The base 210 includes an interior space and contains a liner 242. The liner 242 is enclosed by the walls of the base 210. The liner 242 may be adhered to the interior of the base 210. It can be an aluminum lining, a non-combustible spray-on coating of the interior walls of the base 210, or any other protective cover of the interior walls of the base 210. Preferably, the liner 242 contains a filler 244. The filler 244 can be sand or any other non-combustible and/or fire-extinguishing substance. The liner 242 is preferably secured to the base 210 in a permanent manner that prevents manual removal of the liner 242 from the base 210.

The interior of the base 210 indirectly communicates with the internal passage 224 through the interior 236 and thereby with the opening 204. To dispose of smoking debris, a user places them into the opening 204. The debris falls through the internal passage 224 and the interior 236 and lands on the liner 242. Once the liner 242 is filled with smoking debris, it can be emptied, cleaned, or disposed and replaced with a new liner 242. Alternatively, the base 210 or the entire cigarette urn 200 can be disposed and replaced with a new one. Inexpensive manufacturing and materials of the base/urn as well as low price make disposal of the base/urn possible.

FIG. 2 further illustrates that the second middle portion 208 and upper portion 240 have rounded edges. As can be understood by one having ordinary skill in the relevant art, the shape of the entire cigarette urn 200 inclusive of its upper portion 240, the first and second middle portions 206, 208, and the base 210 can vary according to an ease of shipping as well as an aesthetic appeal. The embodiment in FIG. 2 allows for easy shipping of the urn, because it allows compact packing of various components of the cigarette urn 200. For example, the upper portion 240 and the first and second middle portions 206, 208 can be placed inside the base 210.

The design of the cigarette urn 200 prevents spread of unpleasant odors of smoking debris. Once the debris fall into the liner 242, the narrow internal passage 224 prevents escape of the smoke and other smells. As shown in FIG. 2, each part in the upper portion 240 has a relatively uniform cross-section throughout. Similarly, the cross-section of the base 210 is uniform. Further, the upper portion 240, the first and second middle portions 206, 208 can have varying cross-sections, as compared to the other respective portions. As shown in FIG. 2, the upper portion 240 has a larger cross-section than the cross-section of the first middle portion 206. The upper portion 240 and the first middle portions 206 may have uniform cross-sections throughout, but other cross-sections are feasible. Also, the cigarette urn 200 may have cross-sectional shapes other than the specific shape of the cross-sections shown, i.e., the respective cross-sections can be square, rectangular, round, oval, or any other shape.

Figure 3:
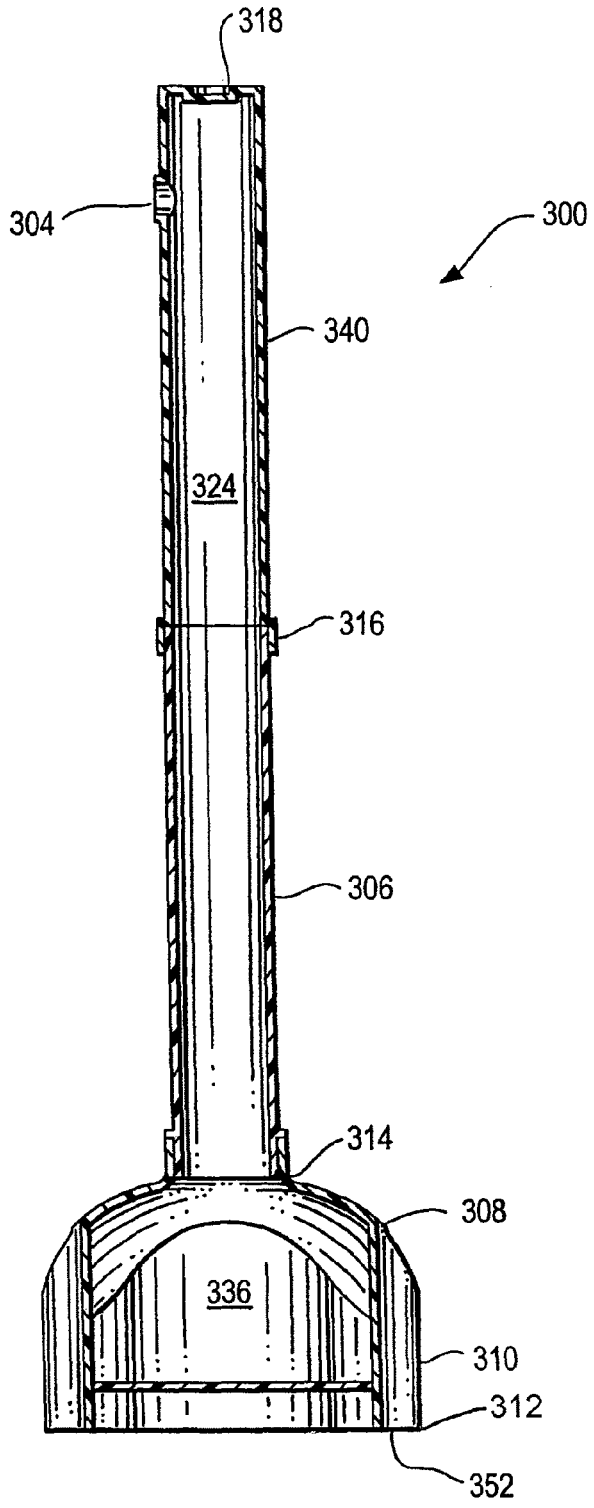
FIG. 3 illustrates an alternate embodiment of a cigarette urn, according to the present invention.
Figure 4:
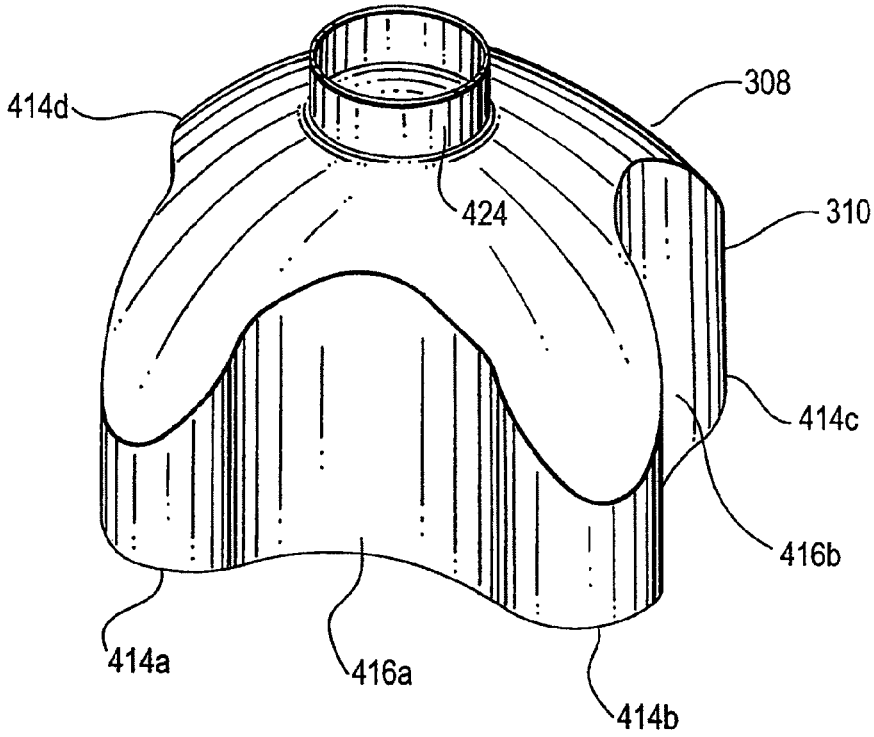
FIG. 4 illustrates a base of the cigarette urn shown in FIG. 3.
Figure 5:
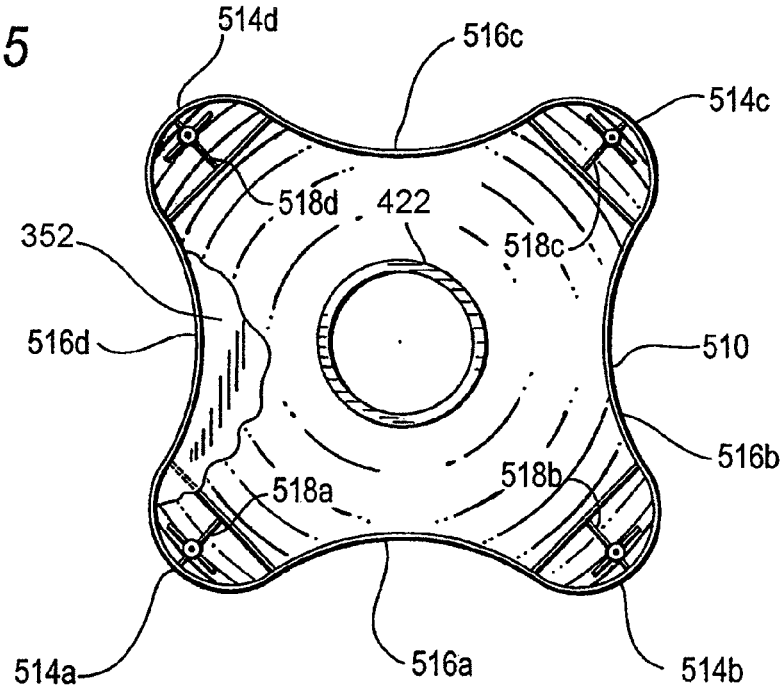
FIG. 5 is a bottom view of the base of the cigarette urn shown in FIG. 3.

FIGS. 3-5 illustrate an alternate design of the cigarette urn 300 suited for disposal in its entirety when filled. The urn 300 includes an upper portion 340 and a base 352. The upper portion 340 is releasably secured to the first middle portion 306 at a junction 316. The first middle portion 306 is in turn releasably secured to the second middle portion 308 at a junction 314. The second middle portion 308 is releasably secured to the base 352 at a junction 312. A liner (not shown in FIG. 3) may be adhered to the interior of the base 352 for collection of smoking debris that enters the cigarette urn 300 through an opening 304 in the upper portion 340.

The upper and first middle portions 340 and 306 include a common internal passage 324 that terminates at the opening. The internal passage 324 is enclosed by the walls of the upper and first middle portions 340 and 306. The second middle portion 308 further includes walls 310 that enclose an interior space 336. The internal passage 324 is further constituted by the interior space 336 through an opening at the junction 314. The interior of the second middle portion 308 communicates with the interior of the base 352.

FIG. 4 illustrates a combination of the base 352 and the second middle portion 308 in more detail. The second middle portion 308 may further include a ring 422 having a threading 424. The ring 422 and the threading 424 releasably secure the first middle portion 306 (not shown in FIG. 4) to the base 352. The first middle portion 306 also contains threading on its interior portion that mates with the threading 424 of the second middle portion 308. To releasably secure the first middle portion 306 to the second middle portion 308, the threading of the first middle portion 306 is mated with the threading 424 on the ring 422. The parts are then rotated along the threading and around their respective axes until the first middle portion 306 is secured to the second middle portion 308. In an alternate embodiment, an additional security can be added in a form of a screw, a bolt, a pin, or other means to secure the two parts together. The additional security can also be inserted through holes made in the threading of each middle portion 306 and 308.

The second middle portion 308 and the base 352 further contain convex portions 416*a*, 416*b* intermixed with concave portions 414*a*, 414*b*, 414*c*, 414*d* (see FIG. 4). The convex portions 416*a*, 416*b* and concave portions 414*a*, 414*b*, 414*c*, 414*d* slope upwards towards the ring 422 at the top of the second middle portion 308. Since the second middle portion 308 and the base 352 are hollow inside, such design allows easy packaging of the second middle portion 308 during shipment. A plurality of the portions 308 can be stacked one on top of each other. As can be understood by one having ordinary skill in the relevant art, the second middle portion 308 is not limited to the one shown in FIG. 4. Other shapes and sizes allowing easy packaging and shipment of the second middle portion 308 and the base 352 are possible.

FIG. 5 further illustrates a bottom 510 of the base 352. The bottom 510 is closed. The bottom 510 includes convex portions 516*a*, 516*b*, 516*c*, 516*d* intermixed with concave portions 514*a*, 514*b*, 514*c*, 514*d*. The convex portions 516*a*, 516*b*, 516*c*, 516*d* and concave portions 514*a*, 514*b*, 514*c*, 514*d* of the bottom 510 correspond to respective convex portions 416*a*, 416*b* and concave portions 414*a*, 414*b*, 414*c*, 414*d* of the second middle portion 308. The bottom 510 further includes attachment mechanisms 518*a*, 518*b*, 518*c*, 518*d* that can secure the base 352 to any surface that the cigarette urn 300 is placed on or to a plate through which fasteners extend (e.g., through holes to the attachment mechanisms 518*a*, 518*b*, 518*c*, 518*d*). The attachment mechanisms 518*a*, 518*b*, 518*c*, 518*d* can include bolts, screws, VELCRO® material, glue, snapon mechanisms, or other types of fasteners. The base 352, therefore, is preferably in a substantially permanently closed condition that is configured to prevent ready opening of the base 352 manually by hands alone. Access to the interior of the base 352 is through the internal passage. Mechanical fasteners may be used to secure the second middle portion 308 to the base 352 at their respective openings that align with each other; their respective openings generally conform in size with each other. The mechanical fasteners may either be secured in a manner that allows them to be removable with an appropriate tool or secured in a way that prevents their removal.

Figure 6:
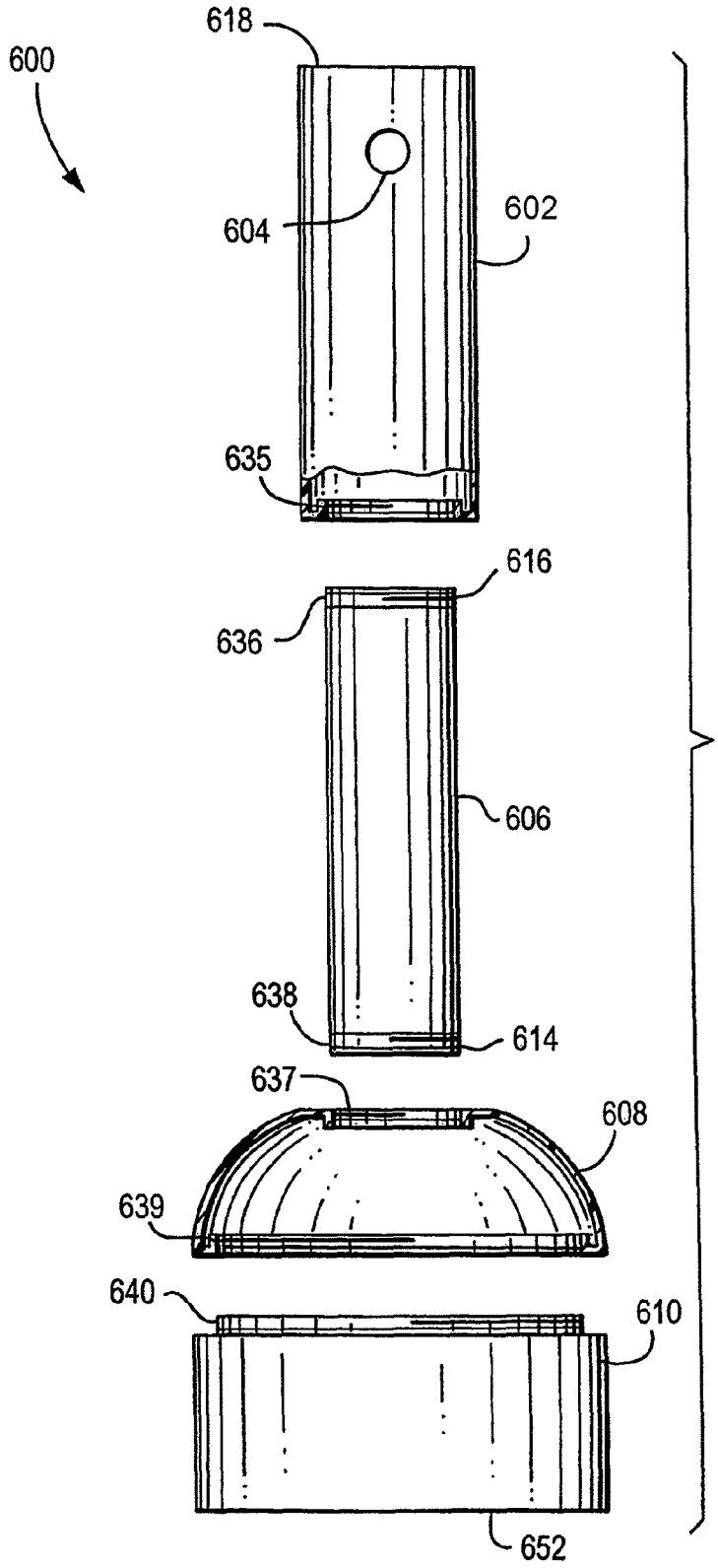
FIG. 6 is an exploded view of the cigarette urn shown in FIG. 1.

FIG. 6 is an exploded view of another alternate embodiment of a cigarette urn 600. The urn 600 contains an upper portion 602 having a closed end 618, a first middle portion 606, a second middle portion 608, and a base 610 with a closed bottom 652. The upper portion 602 further includes an opening 604 for placement of smoking debris. The upper portion 602 can include more than one opening 604.

The upper portion 602 is releasably secured to the first middle portion 606 at a junction 616. The upper portion 602 includes a threading 635 located on its interior surface. The first middle portion 606 contains a threading 636. The threading 635 and the threading 636 interact with each other to releasably secure the upper portion 602 on the first middle portion 606. The threading 635 is configured to fit the threading 636.

Similarly, the first middle portion 606 and the second middle portion 608 include threading 638 and threading 637, respectively. The threading 637 and 638 are configured to releasably secure the middle portions 606 and 608 at a junction 614. Further, the threading 637 is placed inside the second middle portion 608, as shown in FIG. 6.

Similarly, the threading 639 of the second middle portion 608 is configured to releasably secure the base 610 to the second middle portion 608 at a junction 612. The threading 639 contacts a threading 640 to releasably secure the base 610 and second middle portion 608.

As shown in FIG. 6, the upper portion 602 has a larger cross-section than the cross-section of the first middle portion 606. Further, the portions 602, 606, 608 and the base 610 can be further configured to have cross-sections that allow easy packaging of the parts and the base for shipment. Different cross-sections of the parts and the base allow stacking them or placing them one inside the other to preserve space during packaging and shipment procedures.

Figure 7:
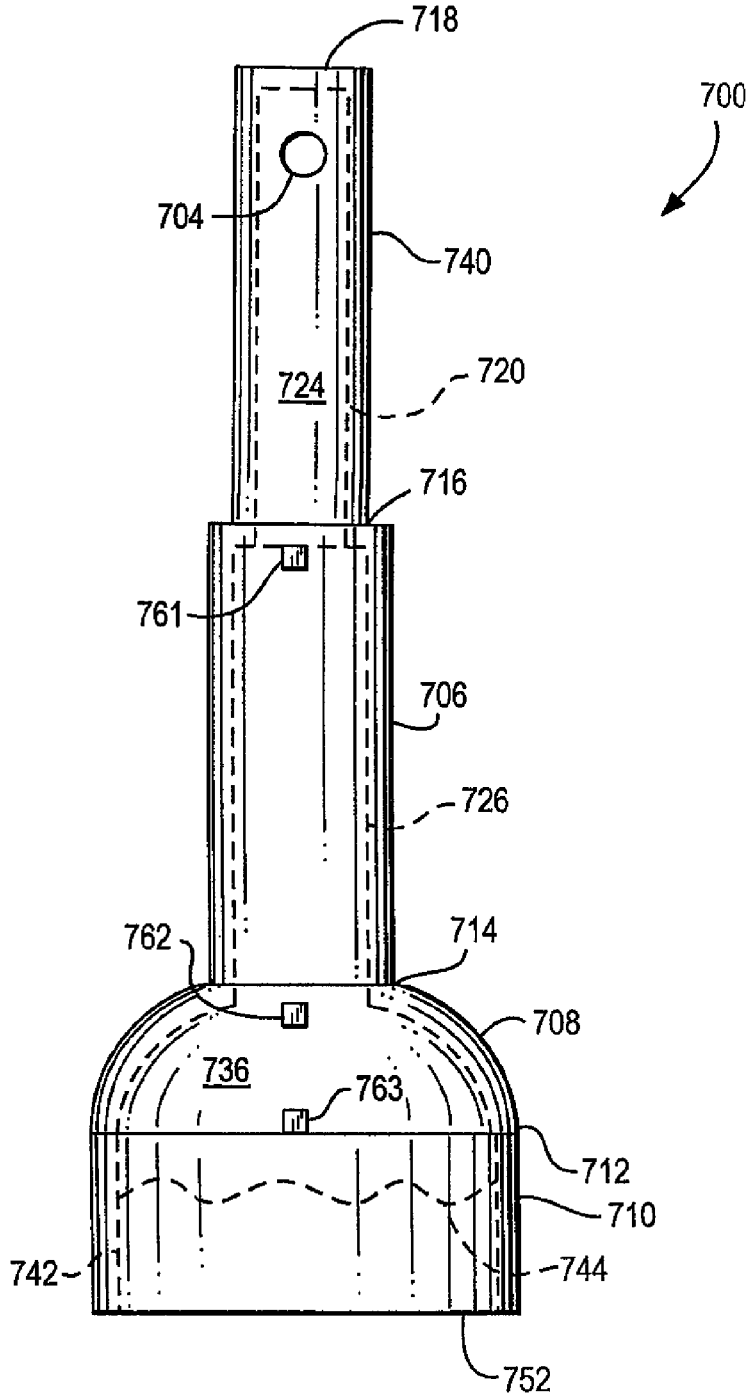
FIG. 7 illustrates another alternate embodiment of a cigarette urn, according to the present invention.

FIG. 7 illustrates an embodiment of a cigarette urn 700, which includes an upper portion 740, a first middle portion 706, a second middle portion 708, and a base 710. The upper portion 740 is releasably coupled to the first middle portion 706; the first middle portion 706 is releasably coupled to the second middle portion 706; and the second middle portion 708 is releasably coupled to the base 710. The upper portion 740 includes a closed top 718. The upper portion 740 further includes an opening 704 for placement of smoking debris. The upper portion 740 may include more than one opening 704.

The base 710 further has a bottom 752. The bottom 752 is used to place the cigarette urn 700 on a surface. The urn 700 may be secured to a surface using bolts, cement, glue, or any other methods.

The upper portion 740 is releasably secured to the first middle portion 706 at a junction 716. The first middle portion 706 is releasably secured to the second middle portion 708 at a junction 714. The second middle portion 708 is releasably secured to the base 710 at a junction 712. The first middle portion 706 has a lager cross-section than the upper portion 740, but smaller than the second middle portion 708. Because of the larger cross-section, the first middle portion 706 may be screwed onto or otherwise joined with the upper portion 740. Also, because of the smaller cross-section than the second middle portion 708, the first middle portion 706 may be screwed onto or otherwise joined with the second middle portion 708. The first middle portion 706 may contain threading at the junctions 714 and 716. Similarly, the upper portion 740 and the second middle portion 708 may contain corresponding threading to mate with first middle portion's threading.

The upper portion 740, the first middle portion 706, and the second middle portion 708 may be secured to each other in numerous other ways. For example, bolts, glue, welding or other methods can be used to couple together the parts of the upper portion 740.

FIG. 7 further illustrates an interior of the cigarette urn 700. The upper portion 740 includes an interior space 720. The interior space 720 is enclosed by the walls of the upper portion 740 and communicates with the opening 704. The first middle portion 706 further includes an interior space 726. The interior space 726 is enclosed by the walls of the first middle portion 706 and communicates with the interior space 720 through an opening at the junction 716. The interior spaces 720 and 726 form a common internal passage 724. The common internal passage 724 is further constituted by interior space 736 of the second middle portion 708 through an opening located at the junction 714. The interior space 736 is enclosed by the walls of the second middle portion 708 and communicates with the interior space of the base 710. The internal passage 724 may have a substantially uniform cross-section throughout the upper and first middle portions parts 740 and 706, respectively.

The base 710 contains a liner 742 enclosed by the interior walls of the base 710. The liner 742 may be adhered to the interior walls of the base 710. It can be an aluminum lining, a non-combustible spray-on coating of the interior portion of the base 710, or any other protective cover of the interior walls of the base 710. The base 710 may contain a filler 744 placed on top of the liner 742. The filler 744 can be sand or any other non-combustible and/or fire-extinguishing substance. The interior passage 724 is constituted by an interior space of the base 710 through the interior 736 to the opening 704.

To dispose of smoking debris, a user places debris into the opening 704. The debris falls through the internal passage 724, the interior 736 and lands on top of the liner 742. Once the liner 742 is filled with smoking debris, it can be emptied, cleaned, or disposed and replaced with a new liner. Alternatively, the base 710 or the entire cigarette urn 700 can be disposed and replaced with a new one. Cheap manufacturing and materials for the base/urn as well as low price make disposal of the base/urn affordable.

In an embodiment, where the liner 742 is reusable, it can be removed from the base 710, emptied, and placed back for further usage. This procedure can be performed periodically or when the liner fills up with the debris.

The design of the cigarette urn 700 prevents spread of unpleasant odors of smoking debris. Once the debris falls into the liner 742, the narrow portion 720 of the internal passage 724 prevents escape of the smoke and other smells. As shown in FIG. 7, the upper portion 740 and the first middle portion 706 have relatively uniform cross-sections throughout. Similarly, the cross-section of the base 710 is uniform. Further, the upper portion 740, the first and second middle portions 706, 708 can have varying cross-sections, as compared to the other respective portions.

In the embodiment shown in FIG. 7, the upper portion 740 is releasably secured to the first middle portion 706 using a bolting mechanism 761. The first middle portion 706 is releasably secured to the second middle portion 708 using a bolting mechanism 762. The second middle portion 708 is releasably secured to the base 710 using a bolting mechanism 763. The upper portion 740 further has a smaller cross-section than the cross-section first middle portion 706. The first middle portion 706 has a smaller cross-section than the second middle portion 708. This allows partial insertion of the respective parts having smaller cross-section than the other (e.g., the upper portion 740 is partially inserted into the first middle portion 706) and releasable securing of the parts using respective bolting mechanisms 761, 762, and 763. Any number of middle portions may be used.

Figure 8:
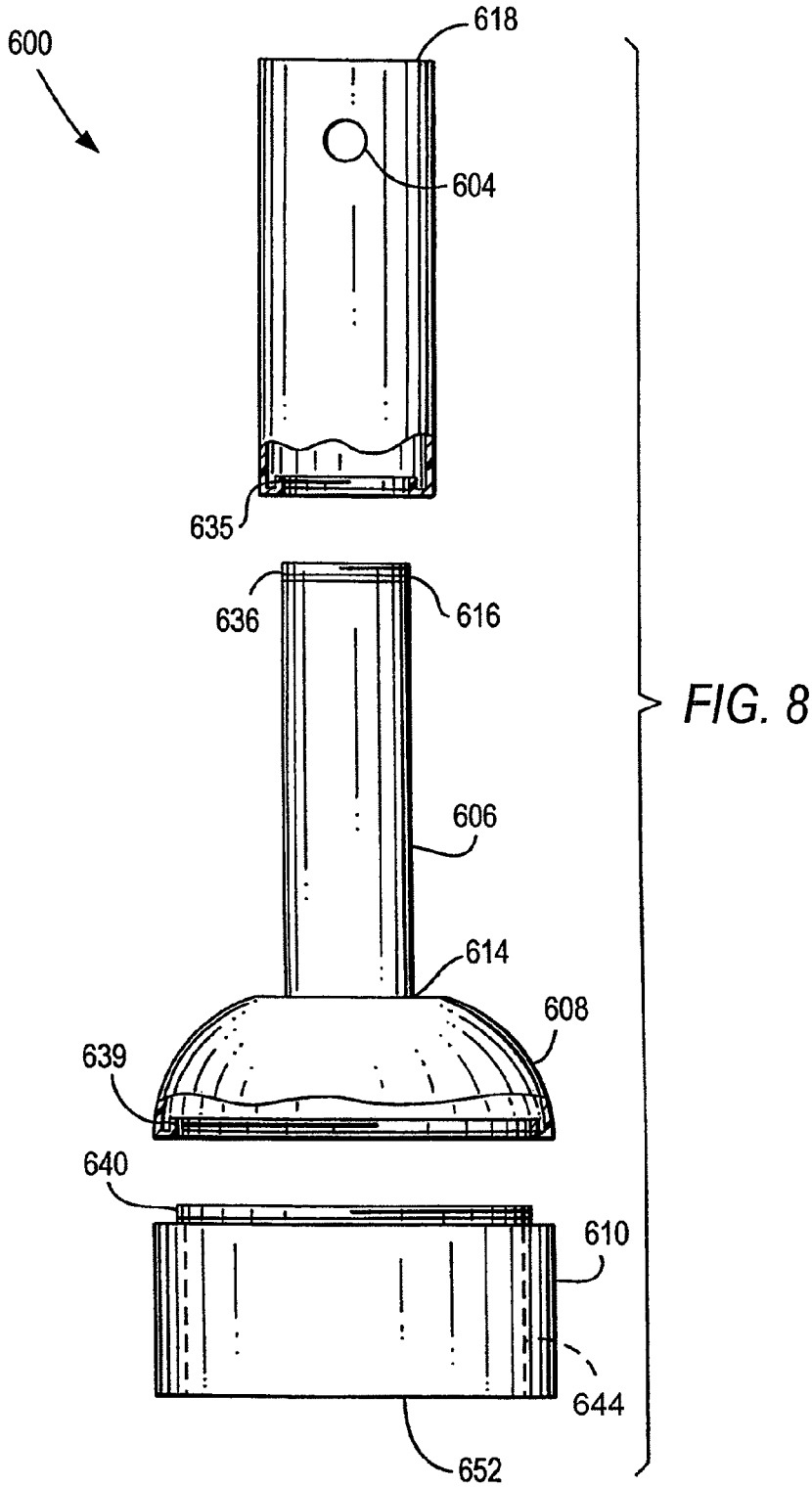
FIG. 8 is another view of the cigarette urn shown in FIG. 6.

FIG. 8 is an exploded view of the cigarette urn 600 that illustrates a liner 644 without a filler. FIG. 8 shows the first and the second middle portions 606 and 608 coupled to each other.

Figure 9:
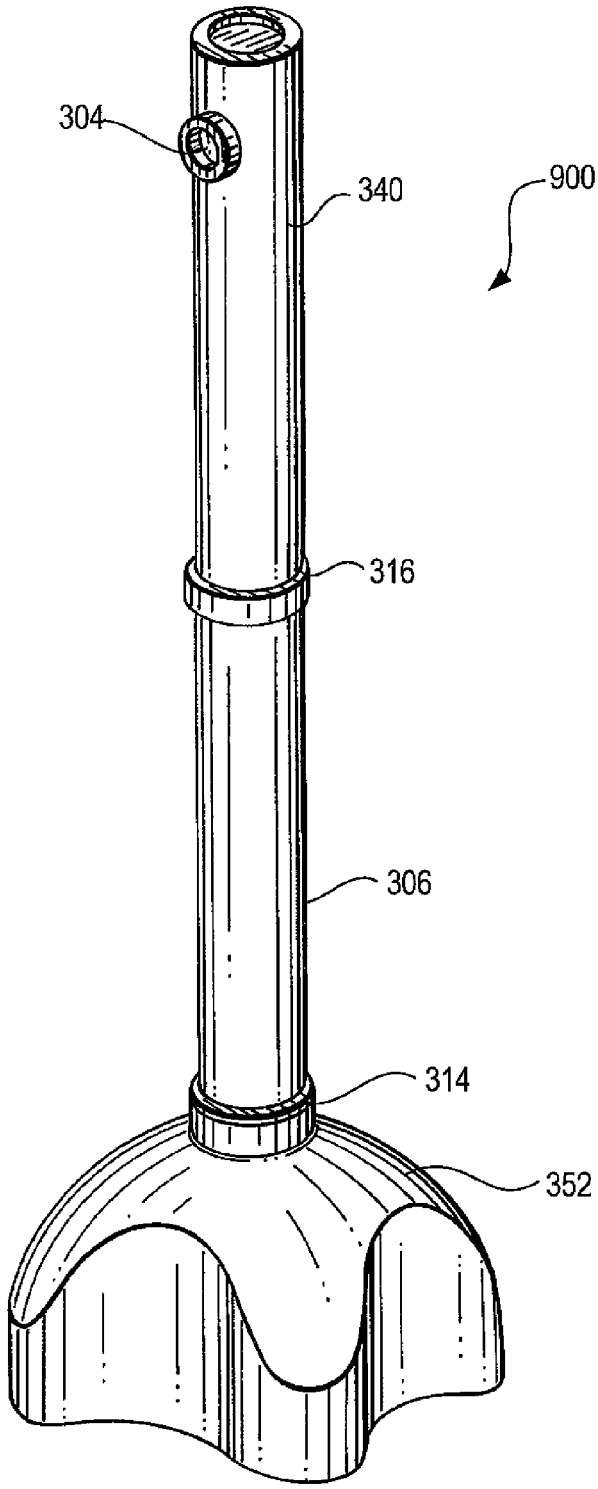
FIG. 9 is a three-dimensional view of the cigarette urn shown in FIG. 3.

FIG. 9 illustrates a three-dimensional view of another embodiment of a cigarette urn 900. This embodiment was also described with respect to FIGS. 3-5.

Figure 10:
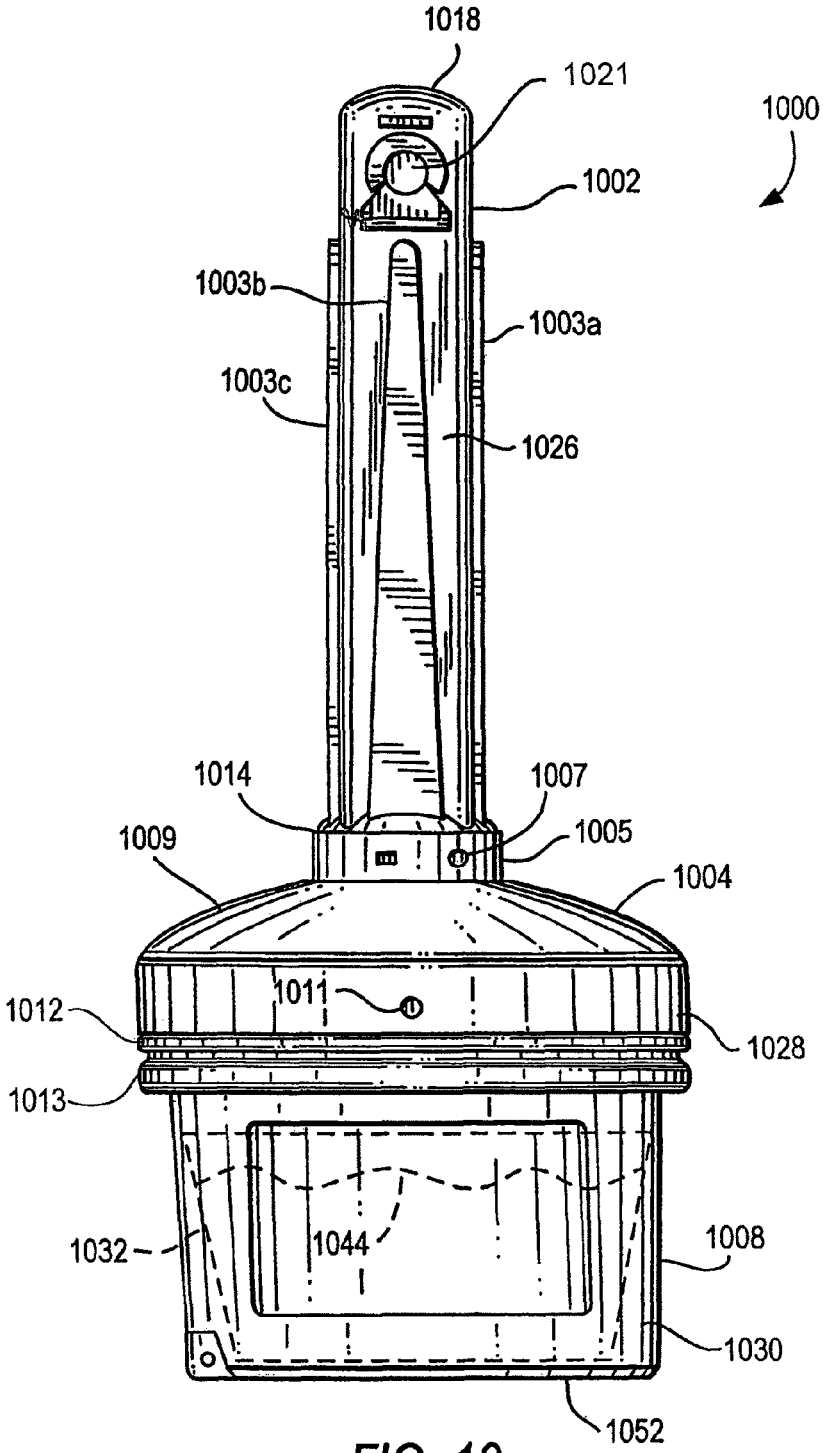
FIG. 10 illustrates yet another embodiment of the cigarette urn, according to the present invention.

FIG. 10 illustrates an embodiment of a cigarette urn 1000. The urn 1000 includes an upper portion 1002, a middle portion 1004, and a base 1008. The upper portion 1002 is releasably secured to the middle portion 1004 at a junction 1014. The middle portion 1004 is releasably secured to the base 1008 at a junction 1012.

The upper portion 1002 further includes a closed top 1018, an opening 1005 in one of the upper portion's sidewalls, a middle portion receiving section 1005, and a middle section locking mechanism 1007. The upper portion 1002 further includes an internal passage 1026 contained within the walls of the upper portion 1002. The upper portion 1002 may also include varying shape and size protrusions 1003*a*, 1003*b*, 1003*c*. The protrusions 1003*a*, 1003*b*, 1003*c* extend away from the upper portion's walls and serve a decorative purpose.

The upper portion's cross-section is uniform throughout the upper portion 1002, except at the middle portion receiving section 1005. The middle portion receiving section 1005 (or a bottom part of the upper portion 1002) has a large cross-section than the cross-section of rest of the upper portion (or an elongated neck part of the upper portion 1002). This way the receiving section 1005 can accommodate a top part (not shown in FIG. 10, but described in connection with FIG. 11 below) of the middle portion 1004.

The middle portion receiving section 1005 further includes at least one locking mechanism 1007. The mechanisms 1007 serve to interlock the upper portion 1002 and the middle portion 1004 together. The locking mechanisms 1007 can be bolts, screws, hooks, VELCRO® material, glue, or numerous other systems and methods that allow the two portions to be securely held together.

To secure the upper portion 1002 to the middle portion 1004, the upper portion is placed on top of the middle portion 1004 and the locking mechanism 1007 is engaged. However, once the locking mechanism 1007 is disengaged, the upper portion 1002 can be removed from the middle portion 1004. Hence, the two portions are releasably secured to each other at the junction 1014.

The middle portion 1004 includes a rounded top 1009 and a top part (not shown in FIG. 10, but described in connection with FIG. 11 below). As described above, the top part is placed inside the middle portion receiving section 1007 of the upper portion 1002 to releasably secure portions 1002 and 1004 together.

The middle portion 1004 further includes an interior portion 1028. The interior portion 1028 communicates with the internal passage 1026 of the upper portion 1002 through the junction 1014. The interior space 1028 is enclosed by the walls of the middle portion 1004. Because the portions 1002 and 1004 are releasably secured to each other as described above, the internal passage 1026 communicates with the interior space 1028. Thus, any smoking debris placed into the opening 1021 falls through the internal passage 1026 and into the interior space 1028.

The middle portion 1004 further contains at least one locking mechanism 1011. The locking mechanism 1011 releasably secures the middle portion 1004 to the base 1008 at a junction 1012, as shown in FIG. 10. A top part (not shown in FIG. 10, but described below with respect to FIG. 11) of the base 1008, is placed inside the middle portion 1004 and the locking mechanism 1011 is engaged. The locking mechanism 1011 is similar to the locking mechanism 1007 of the upper portion 1002. To help separate the middle portion 1004 from the base 1008 during disassembly, a grasping configuration 1013 is provided to enable grasping of the grasping configuration 1013 while one separates the middle portion 1004 from the base 1008.

The grasping configuration 1013 may include a protruding portion and an adjacent recessed portion. The protruding portion includes opposite walls configured to enable grasping the opposite walls for holding the base 1008 steady while rotating the middle portion 1004 relative thereto. The recessed portion is between the protruding portion and the junction 1012 and provides additional clearance above an upper area of the opposite walls to facilitate grasping of the protruding portion. A lower one of the opposite walls forms a boundary with a remainder of the base 1008. This remainder is narrower than the opposite walls, thereby providing clearance below the lower one of the opposite walls for grasping of the protruding portion.

The base 1008 includes an interior portion 1030. The interior portion 1030 is enclosed by the walls of the base 1008. The interior portion 1030 communicates with the interior portion 1028 of the middle portion 1004. The portions 1028 and 1030 communicate with each other in a similar fashion to the communication between the interior portion 1028 and the internal passage 1026 of the upper portion 1002. Thus, any smoking debris that is placed into the opening 1021, falls through the internal passage 1026 and the interior portion 1028 and into the interior portion 1030 of the base 1008.

The interior portion 1030 of the base 1008 contains a liner 1032. The liner 1032 is adhered to the interior of the base 1008. The liner 1032 can be an aluminum liner, a fire-resistant cover, a spray-on fire-resistant coating, a disposable container, or any other liner or container that is attached to the interior of the base. The liner 1032 may also contain a filler 1044. The filler 1044 allows for faster extinguishment of burning smoking debris. In an alternate embodiment, the base 1008 does not include a liner and instead includes the filler 1044 disposed within the interior portion 1030 of the base 1008. In yet another alternate embodiment, the base 1008 does not include the liner 1032 nor the filler 1044. In this case, the base 1008 can be manufactured from a fire resistant material (or any other material that does not burn, melt, or combust) that accumulates smoking debris. In any of the above embodiments, once the base 1008 or the liner 1032 fill up with the smoking debris, the base along with the liner can be emptied and replaced or disposed and replaced.

Figure 11:
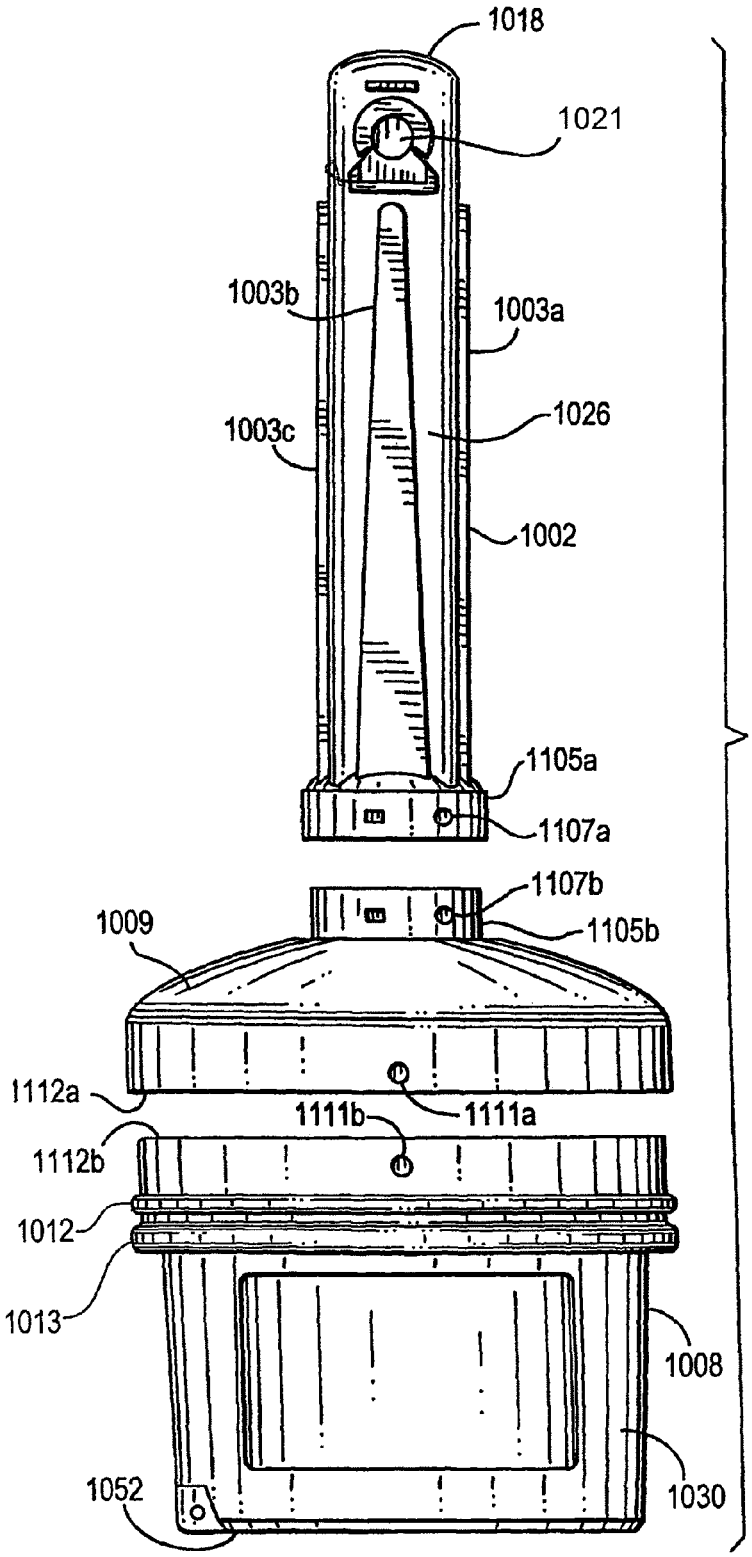
FIG. 11 is an exploded view of the cigarette urn shown in FIG. 10.

FIG. 11 illustrates an exploded view of the cigarette urn 1000 shown in FIG. 10. The exploded view illustrates a top part 1105*b* of the middle portion 1004. The top part 1105*b* is sized to fit within the middle portion receiving section 1105*a*. In an embodiment, the top part 1105*b* has a smaller cross-section than the cross-section of the middle portion receiving section 1105*a* to allow such filling. Further, the top part 1105*b* includes a first locking mechanism 1107*b* and the receiving section 1105 includes a second locking mechanism 1107*a*. The mechanisms 1107*a* and 1107*b* form the locking mechanism 1007 (as shown in FIG. 10) and interact with each other to releasably secure the upper portion 1002 to the middle portion 1004.

The base 1008 includes a top part 1112*b* that is sized to fit inside a base receiving section 1112*a* of the middle portion 1004. The top part 1112*b* has a smaller cross-section than the cross-section of the receiving section 1112*a*. The top part 1112*b* includes a first base locking mechanism hub. The receiving section 1112*a* includes a second base locking mechanism 1111*a*. The mechanisms 1111*a* and 1111*b* form the locking mechanism 1011 (as shown in FIG. 10) and interact with each other to releasably secure the middle portion 1004 and the base 1008.

Figure 12:
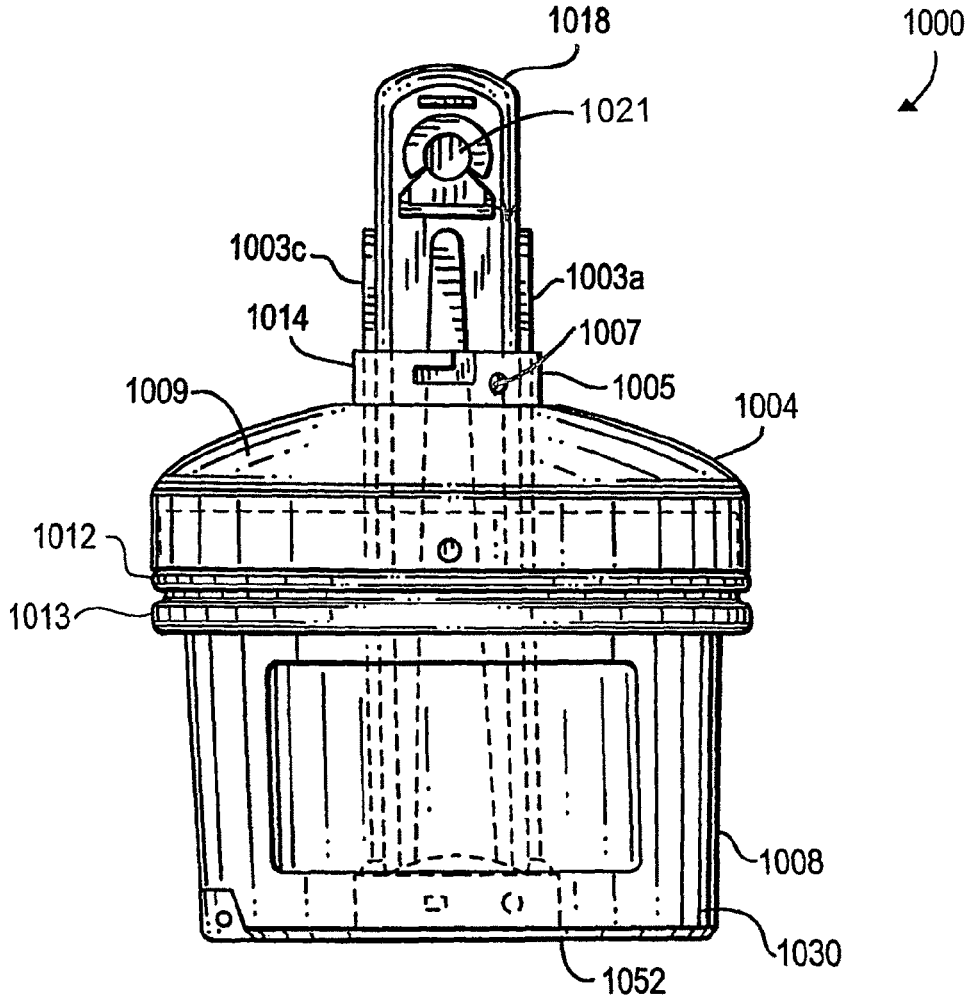
FIG. 12 illustrates a packaged cigarette urn, shown in FIG. 10.

FIG. 12 illustrates a disassembled state of the cigarette urn 1000 shown in FIG. 10. In an embodiment, this state allows easy shipment of the cigarette urn 1000 within a package such as a carton or box. As illustrated in FIG. 11, the upper portion 1002 is removed from the middle portion 1004, then, it is placed inside the base 1008 so that a section of the upper portion 1002 extends from the top part 1105*b*. In this manner, the components of the cigarette urn 1000 overlap each other in an overlapping assembly condition suited for shipment. The overlapping assembly condition takes up or displaces less overall volume than the self-standing, upright condition into which the multiple components may be assembled to define an interior passage through which smoking debris passes when in use. The interior passage is constituted by respective interior spaces defined by each of the multiple components.

Figure 13:
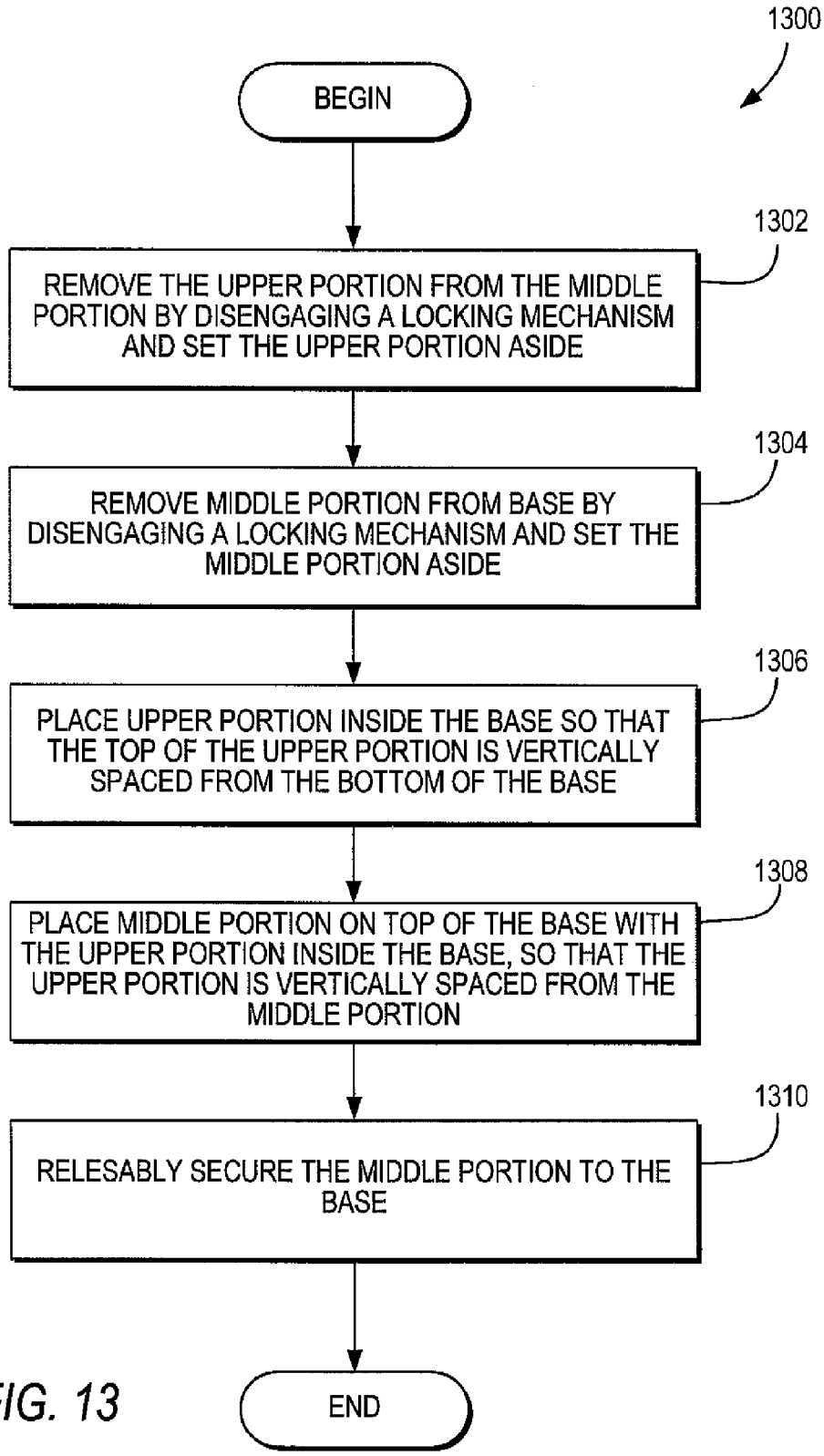
FIG. 13 is a flow chart illustrating a method of packaging cigarette urn, shown in FIG. 10.

FIG. 13 illustrates a method 1300 of packaging the cigarette urn 1000. In step 1302, the upper portion 1002, the middle portion 1004, and the base 1008 are received. An assembled cigarette urn 1000 is received and the upper portion 1002 is removed from the middle portion 1004 by disengaging locking mechanism 1005; and, the middle portion 1004 is removed from the base 1008 by disengaging locking mechanism 1011. Each portion is set aside for further packaging. Alternatively, the upper portion 1002, the middle portion 1004, and the base 1008 can be received separately from each other. Then, the processing proceeds to step 1304.

In step 1304, the upper portion 1004 is placed inside the base 1008. The middle portion receiving section 1105*b* of the upper portion 1004 is placed near the bottom 1052, so that the top 1018 is vertically spaced from the bottom 1052. Then, the processing proceeds to step 1306.

In step 1306, the middle portion 1004 is placed on top of the base 1008 with the upper portion 1002 inside the base 1008. Because the middle portion 1004 includes an opening at the top, the upper portion 1002 is fed through that opening in the top part 1105*b* so that a section of the upper portion 1002 protrudes away from the middle portion 1004, as shown in FIG. 12. Because the cross-section of the upper portion 1002 is smaller (with the exception of the receiving section 1105*a*) than the cross-section of the top part 1105*b*, the upper portion 1002 is able to fit through the top part 1105*b*. The processing then proceeds to step 1308.

In step 1308, the middle portion 1004 is releasably secured to the base 1008 by engaging the locking mechanism 1011. The liner 1032 can also be placed inside the base 1008. In this case, the upper portion 1002 is placed on top of the liner 1032. The upper portion 1002 can be further secured to the middle portion 1004 and the base 1008 using an adhesive tape, glue, VELCRO®, various friction-fit devices (e.g., Styrofoam), or any other materials. In the packaged form, the cigarette urn 1000 can be compactly shipped, which allows for packaging a greater number of units to be placed in a shipping container.

The urn 1000 can be packaged and shipped in other ways. For example, a plurality of bases 1008 may be placed one inside the other. Similarly, a plurality of the middle portions 1004 may be stacked on top of each other. Then, the stacked middle portions 1004 are placed on top of a single upper portion 1002, where the upper portion 1002 protrudes through the openings in the top part of each of the stacked middle portions 1004. If there are any extra upper portions 1002, they can be shipped separately.

Therefore, the present invention relates to disposal of smoking debris. As previously mentioned, one embodiment is a three-piece cigarette urn that includes an upper portion, a middle portion, and a base. The upper portion is coupled to the middle portion. The middle portion is coupled to the base.

The cigarette urns shown in FIGS. 1-12 are not limited to the shapes shown. Specifically, the shape of the urn's upper portion can be uniform or be tapering from its top to the middle portion.

In each of the embodiments, the base includes a hollow interior and a liner may line the hollow interior of the base to collect smoking debris. The liner may be secured to the interior of the base in a permanent manner to prevent its movement relative to the base if the base is jostled. This means that removing the liner, if feasible at all, would require non-manual techniques, such as through chemical, thermal or mechanical treatments or with a tool. Removal could not be accomplished manually by hand alone such as by easily pulling the liner out of the base or by tipping over the base to release the liner. Some examples of securing the liner to the base in a permanent manner include the liner being a spray-on coating or being adhered. The liner is manufactured from a fire resistant material and/or heat resistant material.

The liner may be made of latex or vinyl paints, lacquers, rubbers, varnishes, epoxy resins, plastics, elastomers, urethane, metals, steels, metal composites, TEFLON®, silicon or any combination thereof that is fire retardant and/or heat resistant.

The bottom part of the middle portion is open and connects to the base. The top part of the middle portion includes an opening for connecting to the upper portion. The middle portion is coupled to the upper portion and the base by ways of threaded connectors, bolts, screws, or any other means.

The upper portion further includes a lower part and an elongated neck part. The lower part attaches to the top part of the middle portion. The elongated neck part has a uniform non-tapering rectangular cross-section throughout. The cross-section of the elongated neck part is smaller than the cross-section of the lower part. This allows for attachment to the middle portion's top part. The top of the neck part includes a closed end. In its sidewall and near the closed end, the neck part has at least one opening for disposal of smoking debris.

The neck part further includes an internal passage that communicates with the interior of the middle portion through openings located at the top part of the middle portion and the lower part of the upper portion. The interior of the middle portion further communicates with the interior of the base.

While smoking, a smoker can place the smoking debris through one of the openings. The debris travels through the internal passage in the upper portion. Then, it proceeds through the interior of the middle portion and lands in the base. Because the neck part's cross-section is smaller than the base's cross-section, the cigarette smoke is prevented from coming out through the openings. Hence, the smoking debris is quickly extinguished because of a lack of oxygen. Also, the debris does not burn through the base because the base is protected by a fire resistant liner.

To clean or dispose of the accumulated smoking debris, the upper and middle portions are removed from the base. The base is emptied and then reconnected with the upper and middle portions. Alternatively, the base and/or the entire cigarette urn can be disposed and replaced with a new one.

The three-piece cigarette urn can also be easily shipped. Because the neck part's cross-section is smaller than the opening in the top part of the middle portion, the neck part can be placed inside the base. The middle portion is placed on top of the base that has the upper portion inside it. Thus, the neck part protrudes out of the top part of the middle portion. This allows for compact packaging of the urn. Also, if the urn has a non-removable liner, the liner does not need to be packed separately. Such packaging methods save space during shipping and greatly reduce costs. Other conventional designs require taper for packaging and shipping.

In a further embodiment, the present invention is a cigarette urn that includes a base, an upper portion that is releasably secured to the base. An interior of the base is configured to communicate with an interior of the upper portion. The upper portion has a cross-section that is substantially uniform throughout the upper portion. The upper portion further includes at least one opening in its sidewall.

In an alternate embodiment, the present invention is a cigarette urn that includes a base, an upper portion, and two middle portions. The upper portion is releasably coupled to the first middle portion. The first middle portion is releasably coupled to the second middle portion. The second middle portion is releasably secured to the base. An interior of the upper portion communicates with an interior of the first middle portion. The interior of the first middle portion communicates with an interior of the second middle portion. The interior of the second middle portion communicates with an interior of the base. The upper and first middle portions have uniform cross-sections throughout. The upper portion further includes at least one opening in its sidewall.

The cigarette urn's upper portion has a closed top end. The top end is located opposite where the top part releasably couples to the first middle portion. The base further includes a liner attached to its interior portion. The liner can be permanently secured to the interior portion of the base. In this case, the base along with the liner can be disposed of, once it fills up with smoking debris. In yet an alternate embodiment, the liner can be a fire-resistant spray-on coating.

The upper portion, the first and second middle portions, and the base further include threading that releasably couples the respective components of the urn. In an alternate embodiment, the upper portion, the first and second middle portions, and the base further include bolts, screws, or other attachment mechanisms that releasably couple the portions and the base together.

The upper portion's opening communicates with the interior of the upper portion. It is further configured to receive smoking debris (e.g., cigarette ashes, smoked cigarette butts, etc.) intended for the interior of the base.

In an embodiment, the upper portion and the first middle portion further include a common internal passage. The internal passage is further configured to communicate with the opening and the interior of the second middle portion. The interior space of the second middle portion communicates with the interior space of the base.

In another alternate embodiment, the present invention is a method of assembling a cigarette urn that includes the steps of: (a) receiving a base; (b) receiving a middle portion; (c) receiving an upper portion; (d) releasably securing the upper portion to the middle portion; and (e) releasably securing the base to the middle portion. The upper portion has a substantially uniform cross-section throughout the upper portion. The upper portion has at least one opening in its sidewalls.

In yet another alternate embodiment, the present invention is a method of packaging a cigarette urn that includes the steps of: (a) receiving an upper portion, a middle portion, and a base of the cigarette urn; (b) placing the upper portion inside the base; (c) placing the middle portion on top of the upper portion, and (d) securing the middle portion to the base. A top of the upper portion is vertically spaced from a bottom of the base. The upper portion is fed through an opening in the middle portion so that the top of the upper portion is vertically spaced from the middle portion. The upper portion has a substantially uniform cross-section throughout the upper portion.

Figure 14:
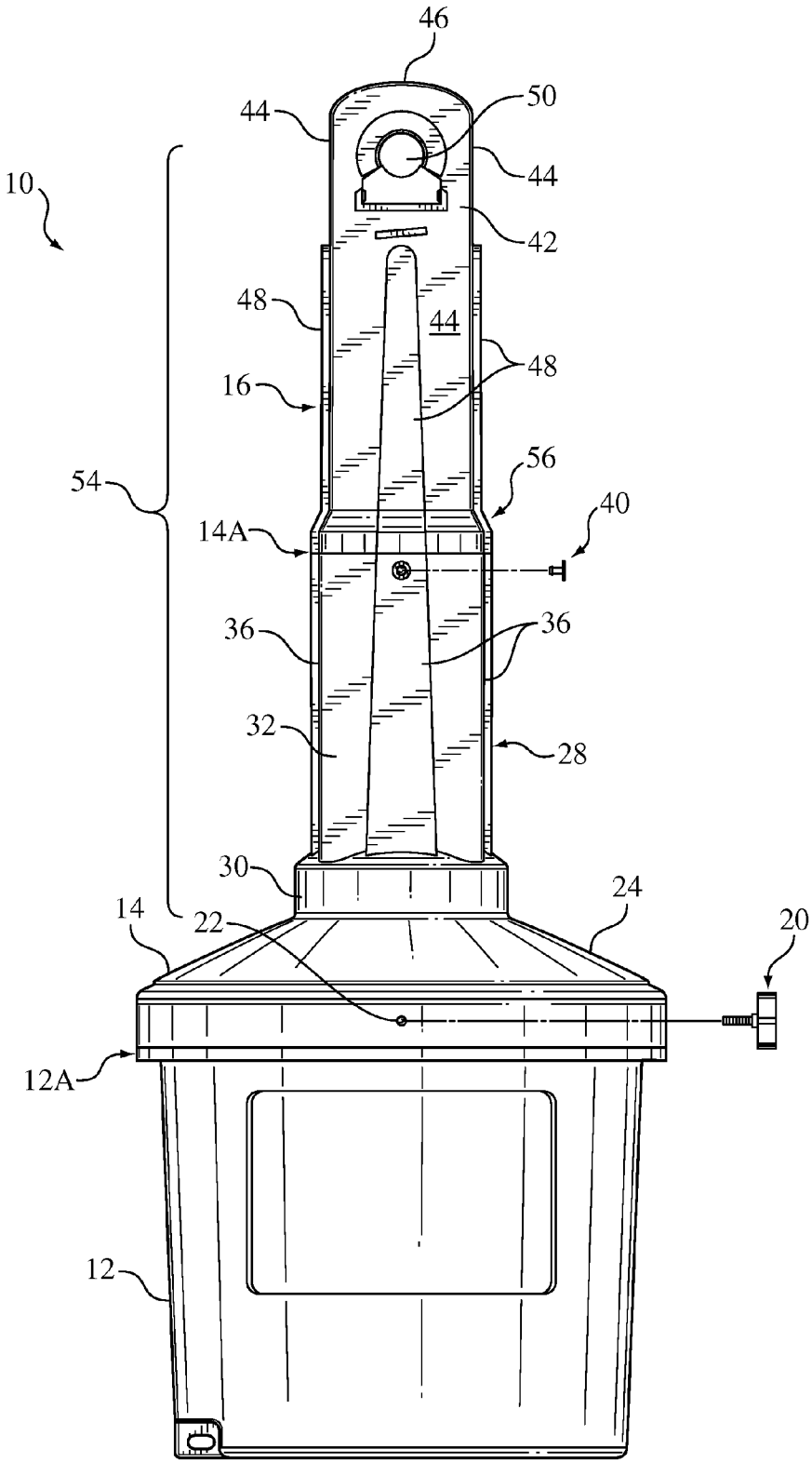
FIG. 14 illustrates yet another embodiment of the cigarette urn, according to the present invention.
Figure 15:
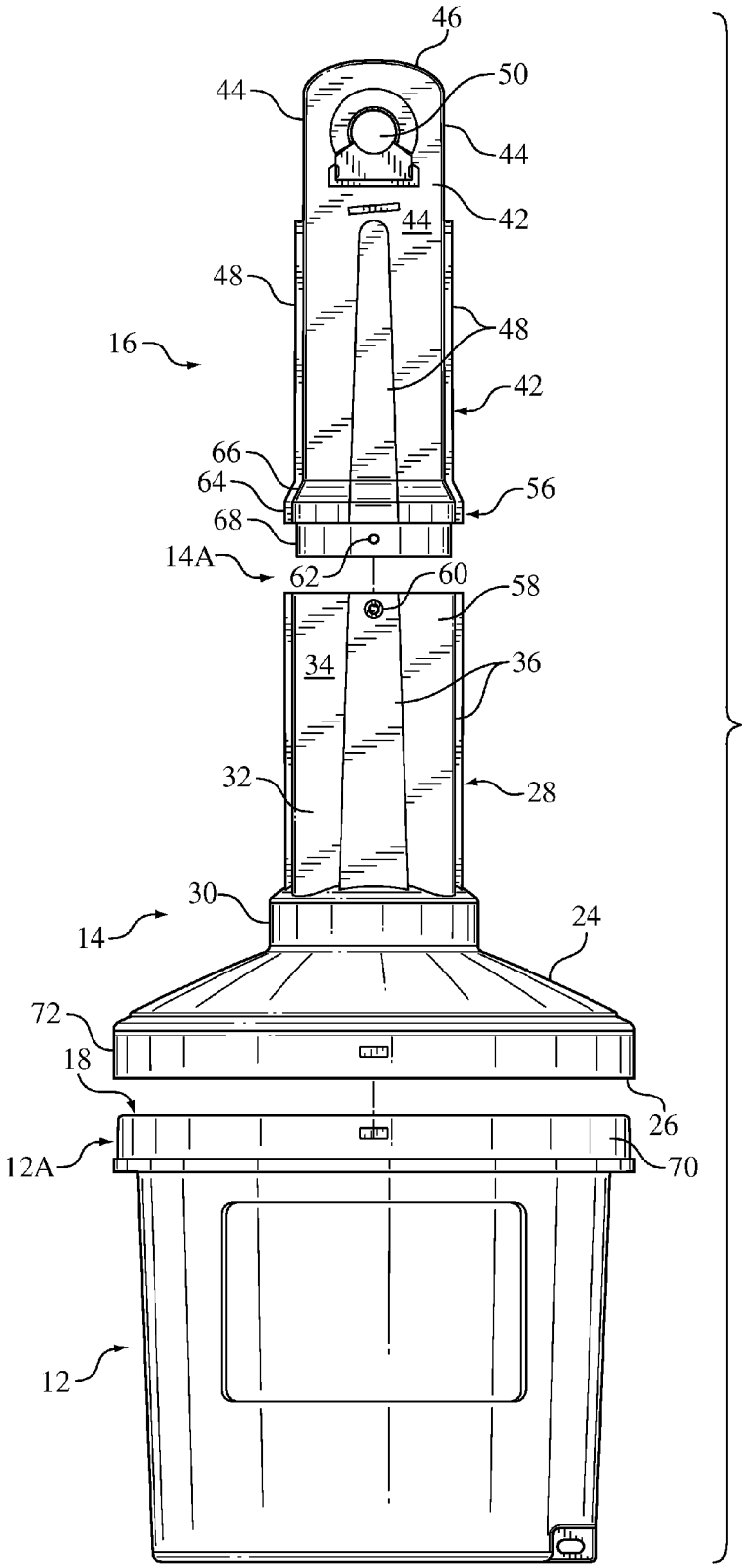
FIG. 15 is an exploded view of the cigarette urn shown in FIG. 14.
Figure 16:
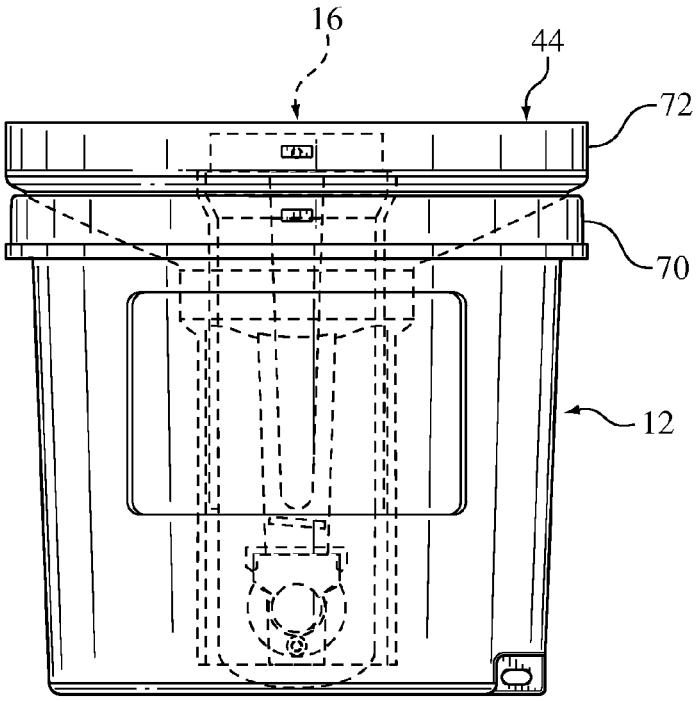
FIG. 16 is a side view of the cigarette urn shown in FIG. 14 in a packaged state.

Another embodiment of a three-piece cigarette urn is shown in FIGS. 14-16 and is designated generally as 10. Urn 10 includes a base 12, a cover 14 that engages with the base 12 and a cap 16 that engages with the cover 14. The cover 14 and cap 16 are generally comparable in function to the middle portion and upper portion, respectively, of the cigarette urns described above. Base 12 may be similar or even identical to the base of any of the cigarette urns described above.

The cigarette urn 10 can include or consists of only these three parts, i.e., the base 12, cover 14 and cap 16, although it may also include other parts. The three parts are constructed to provide the cigarette urn 10 with a use state in which the cigarette urn 10 provides at least one sidewall opening at a height proximate the top of the cigarette urn 10 (shown in FIG. 14) as well as a compact packaged, storage and/or transport state in which the cigarette urn 10 has a very low profile (shown in FIGS. 16 and 16A). The low profile of the cigarette urn 10 in its packaged, storage and/or transport state simplifies packaging and shipping of the cigarette urn 10 and as a result, can reduce costs associated with the packaging, storage and transport of the cigarette urn 10.

The base 12 defines an interior space having an opening 18 at an upper area thereof and which is enclosed by one or more walls defining the base 12. A liner may be arranged in the interior space and optionally adhered to the interior of the base 12. The liner may be an aluminum liner, a fire-resistant cover, a spray-on fire-resistant coating, a disposable container, or any other liner or container that is attached to the interior of the base 12. The liner may also contain a filler. The filler allows for faster extinguishment of burning smoking debris. In an alternate embodiment, the base 12 does not include a liner and instead includes the filler disposed within the interior space of the base 12. In yet another alternate embodiment, the base 12 does not include the liner nor the filler. In this case, the base 12 can be manufactured from a fire resistant material (or any other material that does not burn, melt, or combust) that accumulates smoking debris. In any of these embodiments, once the base 12 or the liner fill up with the smoking debris, the base 12 along with the liner can be emptied and replaced or disposed and replaced.

The base 12 also includes a junction 12A at which the base 12 may be releasably secured to the cover 14. To this end, a locking mechanism is arranged in connection with the base 12 and/or the cover 14 to enable the base 12 and cover 14 to be selectively interlocked together. The locking mechanism may be bolts, screws, hooks, hook and loop material (VELCRO®), glue, or any other systems and methods that would allow the base 12 and cover 14 to be securely held together. FIG. 14 shows this locking mechanism as a threaded bolt 20 with a large head that passes through a hole 22 in the cover 14 and secures the cover 14 to the base 12.

To secure the cover 14 to the base 12, the cover 14 is placed on top of the base 12 and the locking mechanism is engaged. However, once the locking mechanism is disengaged, the cover 14 can be removed from engagement with the base 12. Hence, the base 12 and cover 14 are releasably secured to each other at the junction 12A.

The cover 14 includes a covering portion 24 that tapers inward in a direction away from a lower edge 26 of the cover 14, and an elongate portion 28 that extends upward from the covering portion 24. The covering portion 24 may have an arcuate shape with the elongate portion 28 extending from a center thereof. The elongate portion 28 includes a lower section 30 having a substantially circular outer face and an upper section 32 having four planar outer surfaces 34 and optional varying shape and size protrusions 36 on the surfaces 34. The optional protrusions 36 extend away from the upper section's walls and serve a decorative purpose. Elongate portion 28 has an opening at an upper end or area thereof that communicates with an internal passage that extends internally in the cover 14 through both the covering portion 24 and the elongate portion 28. Thus, the covering portion 24 is substantially annular and defines a lower portion of the passage while the elongate portion 28 defines an upper portion of the passage. This passage may have a variable cross-section depending on the shape of the covering portion 24 and the elongate portion 28. An opening at the bottom of the passage is in communication with the interior space of the base 12 when the base 12 and cover 14 are in their use positions, i.e., the urn 10 is in its use state or configuration.

The cover 14 also includes a junction 14A at which the cover 14 and cap 16 may be releasably secured together. To this end, a locking mechanism is arranged in connection with the cover 14 and/or the cap 16 to enable the cover 14 and the cap 16 to be selectively interlocked together. The locking mechanism may be bolts, screws, hooks, hook and loop material (VELCRO®), glue, or any other systems and methods that would allow the base 12 and cover 14 to be securely held together. As shown in FIG. 14, the locking mechanism is a two button fastener 40 that passes through a hole 60 in the cover 14 and a hole 62 in the cap 16 and thereby secures the cover 14 to the cap 16.

To secure the cap 16 to the cover 14, the cap 16 is placed on top of the cover 14 and the locking mechanism is engaged. However, once the locking mechanism is disengaged, the cap 16 can be removed from engagement with the cover 14.

Hence, the cover 14 and the cap 16 are releasably secured to each other at the junction 14A.

The cap 16 includes an elongate portion 42 having four planar outer surfaces 44 and a closed top 46. The outer surfaces 44 of the cap 16 preferably align and are contiguous with the outer surfaces 34 of the elongate portion 28 of the cover 14 when the cover 14 is secured to the cap 16. A lower portion of the outer surfaces 44 includes varying shape and size protrusions 48 that preferably align with the protrusions 36 on the surfaces 34 of the elongate portion 28. The protrusions 48 extend away from the upper section's wall and serve a decorative purpose.

Figure 16A:
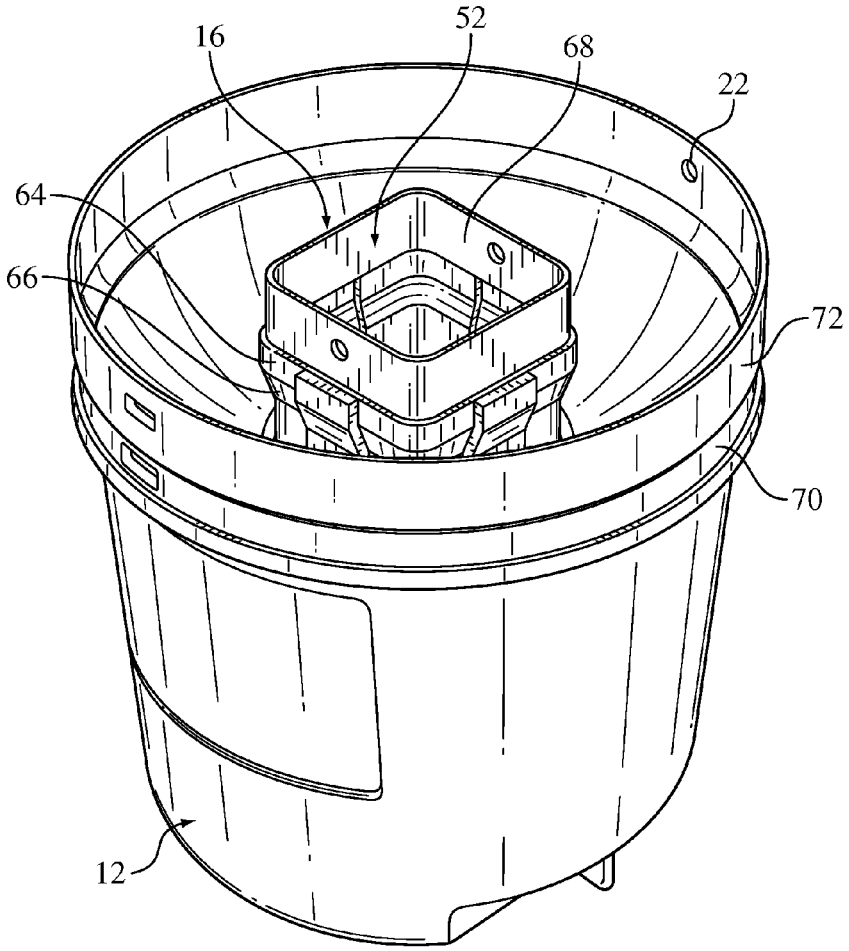
FIG. 16A is a perspective view of the cigarette urn shown in FIG. 14 in the packaged state.

A sidewall opening 50 is formed in one or more of the outer surfaces 44 of the elongate portion 42 and extends through the respective wall(s) defining the elongate portion 42 into a passage 52 that extends internally in the cap 16 from the sidewall opening(s) 50 to an opening at a bottom area or end of the elongate portion 42 (see FIG. 16A). An opening at the bottom of the internal passage 52 is in communication with the passage of the cover 14 when the cover 14 and cap 16 are in their use positions, i.e., the urn 10 is in its use state or configuration.

The combination of the elongate portions 28, 42 provides the urn 10 with a neck 54. In one embodiment, each of the elongate portions 28, 42 defines approximately one-half of the neck 54. The neck 54 may be defined as that portion of the urn 10 from the lower section 30 of the cover 14 to the bottom of the sidewall opening 50. If the neck 54 is defined as the entire vertical extension from the covering portion 24 of the cover 14, then the height of the neck 54 provided by the cap 16 is slightly larger than the height of the neck 54 provided by the elongate portion 28 of the cover 14.

Cigarette urn 10 thus defines a continuous interior conduit from the sidewall opening(s) 50 proximate the upper edge of the urn 10 to the interior space in the base 12, this conduit including the passage 52 through the cap 16 and the passage through the cover 14. Thus, any smoking debris placed into the sidewall opening(s) 50 will fall through this conduit into the interior space in the base 12.

To help separate the cover 14 from the base 12 during disassembly, a grasping configuration may be provided to enable grasping of the grasping configuration while one separates the cover 14 from the base 12 (similar to or the same as grasping configuration 1013 shown in FIGS. 10-12). The grasping configuration may include a protruding portion and an adjacent recessed portion. The protruding portion includes opposite walls configured to enable grasping the opposite walls for holding the base 12 steady while rotating the cover 14 relative thereto. The recessed portion is between the protruding portion and the junction 12A and provides additional clearance above an upper area of the opposite walls to facilitate grasping of the protruding portion. A lower one of the opposite walls forms a boundary with a remainder of the base 12. This remainder is narrower than the opposite walls, thereby providing clearance below the lower one of the opposite walls for grasping of the protruding portion.

FIG. 15 illustrates an exploded view of the cigarette urn 10 shown in FIG. 14. The exploded view illustrates a bottom part 56 of the cap 16. The bottom part 56 is sized to fit within a receiving section 58 of the elongate portion 28 of the cover 14. The bottom part 56 preferably has a smaller cross-section than the cross-section of the receiving section 58 to allow such filling. More specifically, the bottom part 56 includes a flange region 64, a tapered portion 66 extending outward from a lower edge of a remaining portion of the elongate portion 42 to an upper edge of the flange portion 64, and a connecting portion 68 arranged below the flange portion 64. The connecting portion 68 is arranged to fit within an upper edge region of the elongate portion 28 of the cover 14. Also, the flange portion 64 is arranged to provide an outer surface substantially contiguous with an outer surface of the elongate portion 28. Further, as mentioned above, the bottom part 56 includes a hole 62 and the elongate member 28 includes a hole 60 through which a fastener 40 is passed to secure the cap 16 to the cover 14. Instead of holes 60, 62, first and second cooperating locking members may form an alternative locking mechanism and interact with each other to releasably secure the cap 16 to the cover 14. Moreover, other designs for providing a mating structure between the upper end area of the cover 14 and the lower end area of the cap 16 are possible and contemplated to be within the scope and spirit of the invention.

FIG. 15 also illustrates that the base 12 includes a top part 70 sized to fit inside a base receiving section 72 of the cover 14. The top part 70 has a smaller cross-section than the cross-section of the base receiving section 72. The hole 22 through which the threaded bolt 20 is passed is formed in the base receiving section 72 and the top part 70 may also include an aligned hole (not shown). Instead of these holes, first and second cooperating locking members may form an alternative locking mechanism and interact with each other to releasably secure the cover 14 to the base 12. Other designs for providing a mating structure between the upper end area of the base 12 and the lower end area of the cover 14 are possible and contemplated to be within the scope and spirit of the invention.

FIGS. 16 and 16A illustrate a disassembled state of the cigarette urn 10 shown in FIG. 14. This state provides the urn 10 with a very low profile or height and allows easy packaging, transport and storage of the cigarette urn 10 within a package such as a carton or box. In the disassembled state of the urn 10, the cover 14 is in a storage position in which it is inverted from the use position shown in FIGS. 14 and 15 while the cap 16 is also inverted from the use position shown in FIGS. 14 and 15. Importantly, the elongate portion 42 of the cap 16 is partly within the elongate portion 28 of the cover 14. The position of the base 12 is the same in both the use and disassembled states of the urn 10.

Figure 17:
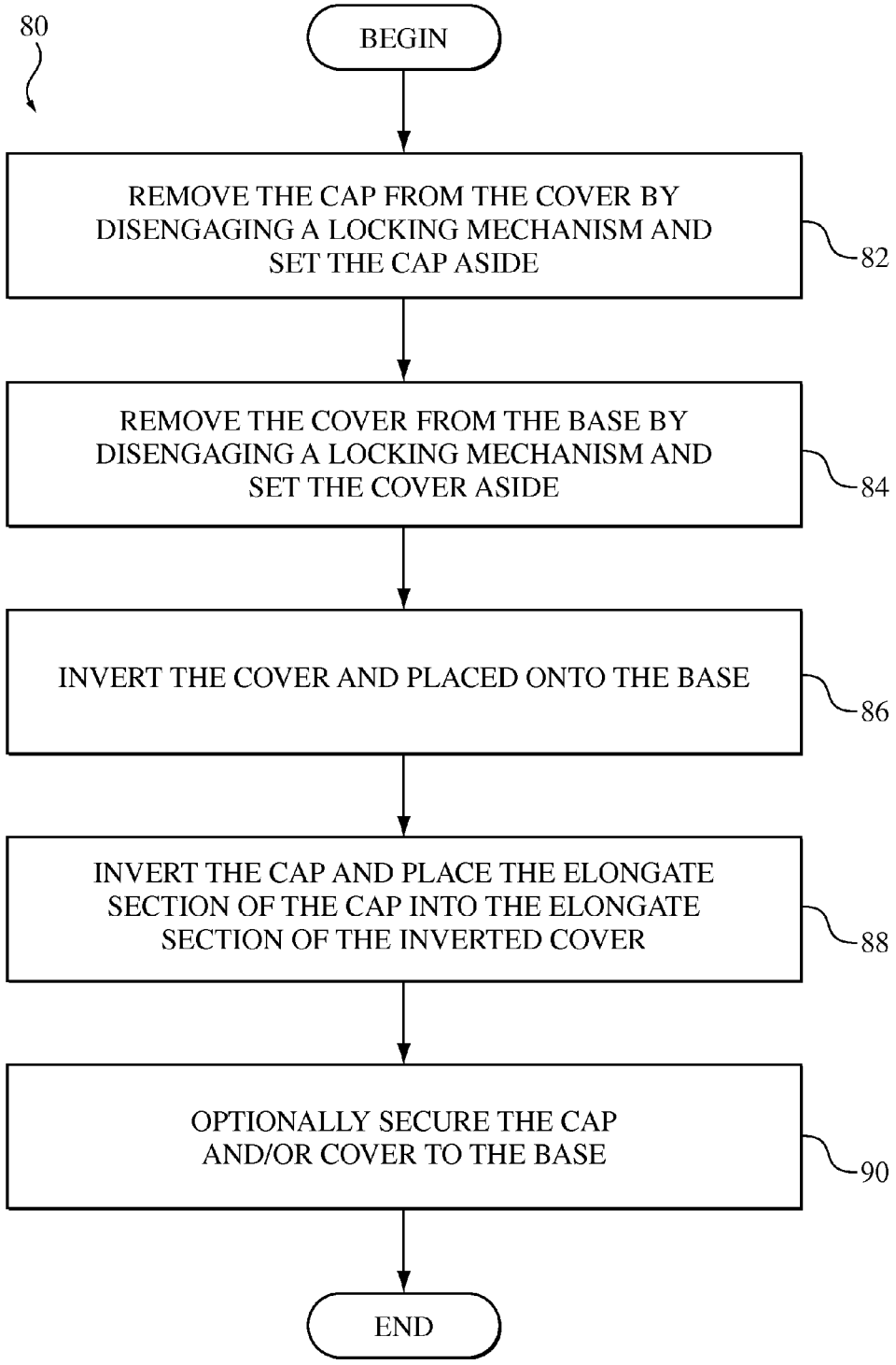
FIG. 17 is a flow chart illustrating a method of packaging the cigarette urn shown in FIG. 14 to provide the state shown in FIGS. 16 and 16A.

FIG. 17 shows a method 80 to disassemble the urn 10 from its use state into a packaging, transport or storage state. In step 82, the cap 16 is removed from engagement with the cover 14 by disengaging their locking mechanism, e.g., removing fastener 40, and in step 84 the cover 14 is removed from engagement with the base 12 by disengaging their locking mechanism, e.g., removing bolt 20. Each part is set aside for further packaging. In step 86, the cover 14 is inverted and placed onto the base 12 such that the elongate portion 28 is in the interior space of the base 12. Then in step 88, the cap 16 is inverted and placed into the cover 14 such that the elongate portion 42 of the cap 16 is inside of the elongate portion 28 of the cover 14. Because the cross-section of the elongate portion 42 of the cap 16 is smaller (with the notable exception of the flange portion 64 of the bottom part 56) than the cross-section of the elongate portion 28 of the cover 14, the cap 16 is able to fit in the internal passage defined by the elongate portion 28. In this manner, the components of the cigarette urn 10 overlap each other in an overlapping assembly condition suited for shipment (see FIGS. 16 and 16A). The overlapping assembly condition takes up or displaces less overall volume than the self-standing, upright condition into which the multiple components may be assembled to define an interior conduit through which passes smoking debris when in use. As a modification to the above method, the elongate portion 42 of the cap 16 may be placed into the elongate portion 28 of the cover 14 prior to inversion of either part and then both the cover 14 and the cap 16 are inverted at the same time.

In step 90, the cover 14 is optionally releasably secured to the base 12. The liner can also be placed inside the base 12. In this case, the elongate portion 28 of the cover 14 and/or closed top 46 of the cap 16 are placed on top of the liner. The cap 16 can be further secured to the cover 14 and/or the base 12 using an adhesive tape, glue, VELCRO®, various friction-fit devices (e.g., Styrofoam), or any other materials. In the packaged form, the cigarette urn 10 can be compactly shipped, which allows for packaging a greater number of units to be placed in a shipping container.

The urn 10 can be packaged and shipped in other ways. For example, a plurality of bases 12 may be stacked one on top of another, a plurality of covers 14 may be stacked one on top of another and a plurality of caps 16 may be stacked one on top of another.

The embodiment of FIGS. 14-16A therefore provides a cigarette urn 10 that includes three parts that provide the urn 10 with either a use state in which an upstanding structure is provide having openings at a convenient height to enable smokers to place debris into the opening or a compact disassembled, storage and transport state in which the urn 10 has a significantly lower height and profile and thus is more easily amenable to packaging, storage and transport. In the latter state, the cover 14 and cap 16 are in different positions relative to one another than the positions they are in when the urn 10 is in its use state, namely, in a partially or completely nested position with the elongate portion 42 of the cap 16 partly or entirely within the confines of the elongate portion 28 of the cover 14 (note that the bottom part 56 may be constructed to fit entirely within the receiving section 58 of the cover 14 and thereby eliminate the larger cross-section of this part of the elongate portion 42 relative to the internal passage in the cover 14 which would prevent a complete nesting of the elongate portion 42 within the elongate portion 28). It is possible to ensure that the cap 16 may be entirely nested within the cover 14 by providing that the cap 16 has a height from a lower edge to an upper edge that is approximately the same as a height of the cover 16 from a lower edge to an upper edge. Similarly, to enable nesting of the elongate portion 42 substantially completely within the elongate portion 28, the elongate portion 42 may have a length in a longitudinal direction that is approximately the same as or slightly smaller than a length of the elongate portion 28 in the longitudinal direction. Also, to enable the storage state of the urn 10 wherein the cap 16 is nested within the cover 14, an inner surface of the elongate portion 28 has a cross-section that is larger than a cross-section of an outer surface of the elongate portion 42 of the cap 16 that is inward of and faces the inner surface of the elongate portion 28.

Urn 10 may also include additional features shown in any of the other urns disclosed herein.

Example embodiments of the methods and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. Thus, the breadth and scope of the present invention should not be limited by any of the above-described exemplary embodiments but should be defined only in accordance with the following claims and their equivalents.

What is claimed is:

1. A cigarette urn having at least one sidewall opening for receiving ashes, cigar and cigarette debris and other waste, comprising:

a base defining an interior space having an opening at an upper area thereof;

a cover having a use position in which it is removably engaged with said base and covers said opening of said base and a storage position in which it is inverted from the use position, said cover including a first elongate portion that defines a through passage having an opening at upper and lower ends, said first elongate portion extending vertically upward from said base when said cover is in its use position; and a cap having a use position in which it is removably engaged with said cover and covers said opening at said upper end of said passage of said cover and a storage position in which it is inverted from the use position, said cap including a second elongate portion that defines the at least one sidewall opening, said second elongate portion defining a through passage having an opening at a lower end and leading from the at least one sidewall opening to said opening at said lower end, said second elongate portion extending vertically upward from said cover when said cap is in its use position, said cover and said cap being structured and arranged relative to said base to provide the urn with a use state in which said cover and said cap are in their use positions to thereby form a conduit from the at least one sidewall opening in said cap through said passages in said cap and said cover to said interior space of said base, said base, said cover and said cap being configured to provide the urn with a storage and transport state in which said cover and said cap are in their storage positions in which they are inverted relative to their use position while an orientation of said base, remains the same, and they are at least partially situated in said interior space of said base, wherein said cap further includes a middle region and a transition region at a lower end of said middle region, said transition region including a flange region, a tapered portion extending outward from a lower edge of said middle region to an upper edge of said flange portion, and a connecting portion arranged below said flange portion, said connecting portion being arranged to fit within an upper edge region of said first elongate portion of said cover, said flange portion being arranged to provide an outer surface substantially contiguous with an outer surface of said first elongate portion.

2. A cigarette urn having at least one sidewall opening for receiving ashes, cigar and cigarette debris and other waste, comprising:

a base defining an interior space having an opening at an upper area thereof;

a cover removably engaged with said base and covering said opening of said base when engaged therewith, said cover including a first elongate portion that defines a through passage having an opening at upper and lower ends, said first elongate portion extending vertically upward from said base when said cover is engaged with said base; and a cap removably engaged with said cover and covering said opening at said upper end of said passage of said cover when engaged with said cover, said cap including a second elongate portion that defines the at least one sidewall opening, said second elongate portion defining a through passage having an opening at a lower end and leading from the at least one sidewall opening to said opening at said lower end, said second elongate portion extending vertically upward from said cover when said cap is engaged with said cover, said first and second elongate portions defining, in combination, a neck of the urn, each of said first and second elongate portions defining approximate one-half of said neck, said base, said cover and said cap being configured to provide the urn with a storage and transport state in which said second elongate portion is at least partly situated in said passage in said first elongate portion and said first elongate portion is at least partly situated in said interior space of said base such that a part of said second elongate portion that is situated in said passage in said first elongate portion is also situated in said interior space of said base, wherein said cap further includes a middle region and a transition region at a lower end of said middle region, said transition region including a flange region, a tapered portion extending outward from a lower edge of said middle region to an upper edge of said flange portion, and a connecting portion arranged below said flange portion, said connecting portion being arranged to fit within an upper edge region of said first elongate portion of said cover, said flange portion being arranged to provide an outer surface substantially contiguous with an outer surface of said first elongate portion.

3. The cigarette urn of claim 2, wherein said cover has a use position in which it is removably engaged with said base and covers said opening of said base and a storage position in which it is inverted from the use position, said cap having a use position in which it is removably engaged with said cover and covers said opening at said upper end of said passage of said cover and a storage position in which it is inverted from the use position, said cover and said cap being structured and arranged relative to said base to provide the urn with a use state in which said cover and said cap are in their use positions to thereby form a conduit from the least one sidewall opening in said cap through said passages in said cap and said cover to said interior space of said base.

4. The cigarette urn of claim 3, wherein said cover and said cap are in their storage positions inverted relative to said base when the urn is in its storage and transport state.

5. A cigarette urn having at least one sidewall opening for receiving ashes, cigar and cigarette debris and other waste, comprising:

a base defining an interior space having an opening at an upper area thereof;

a cover removably engaged with said base and covering said opening of said base when engaged therewith, said cover including a first elongate portion that defines a through passage having an opening at upper and lower ends, said first elongate portion extending vertically upward from said base when said cover is engaged with said base; and a cap removably engaged with said cover and covering said opening at said upper end of said passage of said cover when engaged with said cover, said cap including a second elongate portion that defines the at least one sidewall opening, said second elongate portion defining a through passage having an opening at a lower end and leading from the at least one sidewall opening to said opening at said lower end, said second elongate portion extending vertically upward from said cover when said cap is engaged with said cover, said cover having a height from a lower edge to an upper edge that is approximate the same as a height of said cap from a lower edge to an upper edge, said base, said cover and said cap being configured to provide the urn with a storage and transport state in which said second elongate portion is at least partly situated in said passage in said first elongate portion and said first elongate portion is at least partly situated in said interior space of said base such that a part of said second elongate portion that is situated in said passage in said first elongate portion is also situated in said interior space of said base, wherein said cap further includes a middle region and a transition region at a lower end of said middle region, said transition region including a flange region, a tapered portion extending outward from a lower edge of said middle region to an upper edge of said flange portion, and a connecting portion arranged below said flange portion, said connecting portion being arranged to fit within an upper edge region of said first elongate portion of said cover, said flange portion being arranged to provide an outer surface substantially contiguous with an outer surface of said first elongate portion.

6. The cigarette urn of claim 5, wherein said cover has a use position in which it is removably engaged with said base and covers said opening of said base and a storage position in which it is inverted from the use position, said cap having a use position in which it is removably engaged with said cover and covers said opening at said upper end of said passage of said cover and a storage position in which it is inverted from the use position, said cover and said cap being structured and arranged relative to said base to provide the urn with a use state in which said cover and said cap are in their use positions to thereby form a conduit from the least one sidewall opening in said cap through said passages in said cap and said cover to said interior space of said base.

7. The cigarette urn of claim 6, wherein said cover and said cap are in their storage positions inverted relative to said base when the urn is in its storage and transport state.

8. A method of manufacturing a cigarette urn to enable the cigarette urn to have a compact storage and transport state and a self-standing, upright use state, comprising:

constructing the urn from a base, a cover and a cap, the base defining an interior space having an opening at an upper area thereof, the cover including a first elongate portion that defines a through passage having openings at upper and lower ends, the cap including a second elongate portion that defines at least one sidewall opening and a through passage from the at least one sidewall opening to an opening at a lower end;

to assemble the urn into the use state, engaging the cover to the base such that the cover covers the opening of the base and the first elongate portion extends vertically upward from the base; and engaging the cap with the cover such that the cap covers the opening at an upper end of the passage of the cover and the second elongate portion extends vertically upward from the cover; and to assemble the urn into the compact storage and transport state, inverting the cover and placing the inverted cover into the interior space of the base, and inverting the cap and placing the second elongate portion of the cap into the first elongate portion of the cover.

9. The method of claim 8, wherein the cap is inverted after the cover is inverted such that the second elongate portion of the inverted cap is placed into the first elongate portion of the inverted cap.

10. The method of claim 8, wherein the second elongate portion of the cap is placed into the first elongate portion of the cover and then both the cover and the cap are inverted together.

11. A cigarette urn having at least one sidewall opening for receiving ashes, cigar and cigarette debris and other waste, comprising:

a base defining an interior space having an opening at an upper area thereof;

a cover having a use position in which it is removably engaged with said base and covers said opening of said base and a storage position in which it is inverted from the use position, said cover including a first elongate portion that defines a through passage having an opening at upper and lower ends, said first elongate portion extending vertically upward from said base when said cover is in its use position; and a cap having a use position in which it is removably engaged with said cover and covers said opening at said upper end of said passage of said cover and a storage position in which it is inverted from the use position, said cap including a second elongate portion that defines the at least one sidewall opening, said second elongate portion defining a through passage having an opening at a lower end and leading from the at least one sidewall opening to said opening at said lower end, said second elongate portion extending vertically upward from said cover when said cap is in its use position, said cover and said cap being structured and arranged relative to said base to provide the urn with a use state in which said cover and said cap are in their use positions to thereby form a conduit from the at least one sidewall opening in said cap through said passages in said cap and said cover to said interior space of said base, said cap further including a middle region and a transition region at a lower end of said middle region, said transition region including a flange region, a tapered portion extending outward from a lower edge of said middle region to an upper edge of said flange portion, and a connecting portion arranged below said flange portion, said connecting portion being arranged to fit within an upper edge region of said first elongate portion of said cover, said flange portion being arranged to provide an outer surface substantially contiguous with an outer surface of said first elongate portion.

12. The cigarette urn of claim 11, wherein said base, said cover and said cap are structured and arranged to provide the urn with a storage and transport state in which said cover and said cap are in their storage positions wherein said first elongate portion is at least partly situated in said interior space of said base and said second elongate portion is at least partly situated in said passage in said first elongate portion such that said second elongate portion is also situated in said interior space of said base to thereby provide the urn with a height in the storage and transport state smaller than a height of the urn in the use state.

13. The cigarette urn of claim 11, wherein said first and second elongate portions define, in combination, a neck of the urn.

14. The cigarette urn of claim 13, wherein each of said first and second elongate portions define approximate one-half of said neck.

15. The cigarette urn of claim 11, wherein said cover has a height from a lower edge to an upper edge that is approximate the same as a height of said cap from a lower edge to an upper edge.

16. The cigarette urn of claim 11, wherein said cap and said cover are arranged such that said first elongate portion of said cover has an inner surface defining a cross-sectional area that is larger than a cross-sectional area defined by an outer surface of said second elongate portion of said cap such that when said second elongate portion is situated in said through passage of said first elongate portion, said outer surface of said second elongate portion is inward of and faces said inner surface of said first elongate portion.

17. A cigarette urn having at least one sidewall opening for receiving ashes, cigar and cigarette debris and other waste, comprising:

a base defining an interior space having an opening at an upper area thereof;

a cover removably engaged with said base and covering said opening of said base when engaged therewith, said cover including a first elongate portion that defines a through passage having an opening at upper and lower ends, said first elongate portion extending vertically upward from said base when said cover is engaged with said base; and a cap removably engaged with said cover and covering said opening at said upper end of said passage of said cover when engaged with said cover, said cap including a second elongate portion that defines the at least one sidewall opening, said second elongate portion defining a through passage having an opening at a lower end and leading from the at least one sidewall opening to said opening at said lower end, said second elongate portion extending vertically upward from said cover when said cap is engaged with said cover, said first and second elongate portions defining, in combination, a neck of the urn, each of said first and second elongate portions defining approximate one-half of said neck, said cap further including a middle region and a transition region at a lower end of said middle region, said transition region including a flange region, a tapered portion extending outward from a lower edge of said middle region to an upper edge of said flange portion, and a connecting portion arranged below said flange portion, said connecting portion being arranged to fit within an upper edge region of said first elongate portion of said cover, said flange portion being arranged to provide an outer surface substantially contiguous with an outer surface of said first elongate portion.

18. The cigarette urn of claim 17, wherein outer surfaces of said first and second elongate portions are substantially contiguous when said cap is engaged with said cover.

19. The cigarette urn of claim 17, wherein said cover has a height from a lower edge to an upper edge that is approximate the same as a height of said cap from a lower edge to an upper edge.

20. The cigarette urn of claim 17, wherein said cap and said cover are arranged such that said first elongate portion of said cover has an inner surface defining a cross-sectional area that is larger than a cross-sectional area defined by an outer surface of said second elongate portion of said cap such that when said second elongate portion is situated in said through passage of said first elongate portion, said outer surface of said second elongate portion is inward of and faces said inner surface of said first elongate portion.

21. A cigarette urn having at least one sidewall opening for receiving ashes, cigar and cigarette debris and other waste, comprising:

a base defining an interior space having an opening at an upper area thereof;

a cover removably engaged with said base and covering said opening of said base when engaged therewith, said cover including a first elongate portion that defines a through passage having an opening at upper and lower ends, said first elongate portion extending vertically upward from said base when said cover is engaged with said base; and a cap removably engaged with said cover and covering said opening at said upper end of said passage of said cover when engaged with said cover, said cap including a second elongate portion that defines the at least one sidewall opening, said second elongate portion defining a through passage having an opening at a lower end and leading from the at least one sidewall opening to said opening at said lower end, said second elongate portion extending vertically upward from said cover when said cap is engaged with said cover, said cover having a height from a lower edge to an upper edge that is approximate the same as a height of said cap from a lower edge to an upper edge, said cap further including a middle region and a transition region at a lower end of said middle region, said transition region including a flange region, a tapered portion extending outward from a lower edge of said middle region to an upper edge of said flange portion, and a connecting portion arranged below said flange portion, said connecting portion being arranged to fit within an upper edge region of said first elongate portion of said cover, said flange portion being arranged to provide an outer surface substantially contiguous with an outer surface of said first elongate portion.

22. The cigarette urn of claim 21, wherein outer surfaces of said first and second elongate portions are substantially contiguous when said cap is engaged with said cover.

23. The cigarette urn of claim 21, wherein said cap and said cover are arranged such that said first elongate portion of said cover has an inner surface defining a cross-sectional area that is larger than a cross-sectional area defined by an outer surface of said second elongate portion of said cap such that when said second elongate portion is situated in said through passage of said first elongate portion, said outer surface of said second elongate portion is inward of and faces said inner surface of said first elongate portion.

* * * * *